US011247363B2

(12) United States Patent
Seigneur et al.

(10) Patent No.: US 11,247,363 B2
(45) Date of Patent: Feb. 15, 2022

(54) SAW CHAIN PRESETS

(71) Applicant: Oregon Tool, Inc., Portland, OR (US)

(72) Inventors: Christopher D. Seigneur, West Linn, OR (US); Michael D. Harfst, Milwaukie, OR (US); Evan Pickett, Tigard, OR (US); James Matthew Cunnington, Tualatin, OR (US)

(73) Assignee: Oregon Tool, Inc., Portland, OR (US)

( * ) Notice: Subject to any disclaimer, the term of this patent is extended or adjusted under 35 U.S.C. 154(b) by 0 days.

(21) Appl. No.: 16/249,864

(22) Filed: Jan. 16, 2019

(65) Prior Publication Data

US 2019/0224880 A1 Jul. 25, 2019

Related U.S. Application Data

(60) Provisional application No. 62/621,021, filed on Jan. 23, 2018.

(51) Int. Cl.
*B27B 33/14* (2006.01)

(52) U.S. Cl.
CPC ..... *B27B 33/14* (2013.01)

(58) Field of Classification Search
CPC ..... B27B 33/14; B27B 33/141; B27B 33/142; B27B 17/00; F16B 39/30
See application file for complete search history.

(56) References Cited

U.S. PATENT DOCUMENTS 741,453 A 10/1903 Butler et al.
953,428 A 3/1910 Morse
1,743,157 A 1/1930 Morse
2,747,624 A 5/1956 Cox
RE24,475 E 5/1958 Siverson
(Continued)

FOREIGN PATENT DOCUMENTS

AT 506031 B1 5/2009
CN 203257980 U 10/2013
(Continued)

OTHER PUBLICATIONS

English Translation of JP85003904. (Year: 1985).*
PCT Application No. PCT/US2019/013874; International Search Report and Written Opinion; dated May 3, 2019.

*Primary Examiner* — Jennifer S Matthews
(74) *Attorney, Agent, or Firm* — Schwabe, Williamson & Wyatt, P.C.

(57) ABSTRACT

Embodiments herein describe presets for saw chains comprised of one or more rivets that are coupled to a tiestrap. Each rivet may further comprise a central flange and a hub protruding from opposed sides from the flange. In some embodiments, the hub may be non-concentric from the flange, and the flange may be non-circular, such as ovoid or cam-shaped. In some embodiments, various portions of the flange, rivet, and tiestrap may be selectively hardened to various degrees of hardness, depending upon their location and usage. In some embodiments, the rivets may be prevented from rotating with respect to the tiestrap using a brazing process, and may be configured to facilitate such processes. Other embodiments may employ a non-circular hub. Still other embodiments may use a low-temperature process for soldering that does not affect the hardness of the tiestrap or rivet.

19 Claims, 17 Drawing Sheets

(56) References Cited

U.S. PATENT DOCUMENTS

| | | | | |
|---|---|---|---|---|
| 2,902,068 | A | 9/1959 | Gudmudsen | |
| 3,020,942 | A | 2/1962 | Hill | |
| 3,291,169 | A | 12/1966 | Mörner | |
| 3,421,313 | A | 1/1969 | Harada et al. | |
| 3,464,201 | A | 9/1969 | Ehlen | |
| 3,585,872 | A | 6/1971 | McDowell | |
| 3,590,650 | A | 7/1971 | Rollins | |
| 3,931,706 | A | 1/1976 | McKeon et al. | |
| 4,037,403 | A | 7/1977 | Lanz et al. | |
| 4,118,995 | A | 10/1978 | Lanz et al. | |
| 4,211,136 | A * | 7/1980 | Geurian | B27B 33/14 83/830 |
| 4,378,719 | A | 4/1983 | Burgess | |
| 4,434,556 | A | 3/1984 | Nitschmann et al. | |
| 4,756,221 | A | 7/1988 | Nitschmann et al. | |
| 4,896,575 | A | 1/1990 | Sundström | |
| 4,898,057 | A | 2/1990 | Hille | |
| 4,934,052 | A | 6/1990 | Nitschmann et al. | |
| 5,131,150 | A | 7/1992 | Muehling | |
| 5,136,783 | A | 8/1992 | Bell et al. | |
| 5,153,996 | A | 10/1992 | Kuzarov et al. | |
| 5,386,756 | A | 2/1995 | Stehle et al. | |
| 5,404,707 | A | 4/1995 | Suzuki | |
| 5,651,938 | A | 7/1997 | Thomson et al. | |
| 5,729,882 | A | 3/1998 | Travis | |
| 5,772,957 | A | 6/1998 | Thomson et al. | |
| 6,138,658 | A | 10/2000 | Bell | |
| 6,390,943 | B1 | 5/2002 | Dreger et al. | |
| 6,988,862 | B1 | 1/2006 | Iguchi et al. | |
| 7,516,688 | B2 | 4/2009 | Raczykowski | |
| 7,563,064 | B2 | 7/2009 | Seigneur et al. | |
| 7,891,279 | B2 * | 2/2011 | Seigneur | B27B 33/14 83/835 |
| 8,342,163 | B2 | 1/2013 | Osborne et al. | |
| 8,602,015 | B2 | 12/2013 | Michelon | |
| 9,233,483 | B2 | 1/2016 | Michelon | |
| 9,573,294 | B2 | 2/2017 | Buchholtz et al. | |
| 9,757,808 | B2 | 9/2017 | Harfst et al. | |
| 2004/0182216 | A1 | 9/2004 | Morrison | |
| 2007/0026987 | A1 | 2/2007 | Miura | |
| 2007/0012946 | A1 | 6/2007 | Seigneur | |
| 2007/0125219 | A1 | 6/2007 | Seigneur et al. | |
| 2008/0034938 | A1 * | 2/2008 | Fuchs | B27B 33/14 83/830 |
| 2009/0017950 | A1 | 1/2009 | Sandro et al. | |
| 2012/0132051 | A1 | 5/2012 | Moller | |
| 2013/0121788 | A1 | 5/2013 | Yu | |
| 2013/0319201 | A1 | 12/2013 | Schulz | |
| 2014/0090631 | A1 | 4/2014 | Michelon | |
| 2014/0260875 | A1 | 9/2014 | Harfst et al. | |
| 2014/0298963 | A1 | 10/2014 | Ruzich | |
| 2016/0193749 | A1 | 7/2016 | Seigneur et al. | |
| 2017/0197327 | A1 | 7/2017 | Harfst et al. | |
| 2019/0151970 | A1 * | 5/2019 | Strand | B23D 61/02 |

FOREIGN PATENT DOCUMENTS

| | | | | |
|---|---|---|---|---|
| DE | 1403692 | A1 * | 10/1968 | B27B 33/14 |
| DE | 4309464 | A1 * | 9/1994 | B27B 33/14 |
| DE | 102006037330 | A1 | 2/2008 | |
| EA | 000372 | B1 * | 6/1999 | |
| EP | 0304270 | A2 | 2/1989 | |
| EP | 3042742 | A1 | 7/2016 | |
| EP | 3050685 | A1 | 8/2016 | |
| EP | 2663432 | B1 | 8/2017 | |
| FR | 2323481 | A1 | 4/1977 | |
| FR | 2695060 | A1 | 3/1994 | |
| FR | 2702988 | A1 | 9/1994 | |
| GB | 888980 | A | 2/1962 | |
| JP | 85003904 | * | 1/1985 | |
| WO | WO9733731 | A1 | 9/1997 | |
| WO | WO2008061204 | A2 | 5/2008 | |
| WO | WO-2010090895 | A1 * | 8/2010 | B27B 33/14 |

* cited by examiner

Attorney-Docket No. 108643-243885
IPN: P00.776
Date of Transmission: Jan-16-2019
Page 1 of 17

SAW CHAIN PRESETS

CROSS-REFERENCE TO RELATED APPLICATION

This application claims the priority benefit of the earlier filing date of U.S. Provisional Patent Application No. 62/621,021, filed Jan. 23, 2018, which is hereby incorporated herein by reference in its entirety.

TECHNICAL FIELD

Embodiments herein relate to the field of saw chains, and more specifically, to various improvements to saw chain presets, including oriented rivets, post-assembly selective heat treatment, brazing between rivets and tiestraps, and low-temperature assembly of rivets to a tiestrap.

BACKGROUND

Saw chain used on chain saws, including industrial-scale equipment such as timber harvesters, and construction equipment including chain saws designed for concrete and/or stone cutting, typically include a plurality of links, such as cutter links, drive/connector links, and presets. Cutter links may be configured for cutting wood, metal, concrete, stone, or any other material, with the links being specifically configured for the material intended to be cut, e.g. chisel points for wood, diamond tipped cutters for concrete, etc. Presets are assemblies that typically consist of one or more rivets that are assembled to a tiestrap. The configuration and assembly of a preset has a direct impact on the longevity and safety of a saw chain. If a link, which may be comprised of a preset, breaks, it can result in a chain shot event, where the momentum of the moving chain as it whips around the saw bar can throw pieces of the chain at speeds approaching that of a bullet. A factor in the likelihood of a chain shot event is rivet and tiestrap wear, which can be related to the configuration and assembly of the various presets that may comprise a saw chain.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
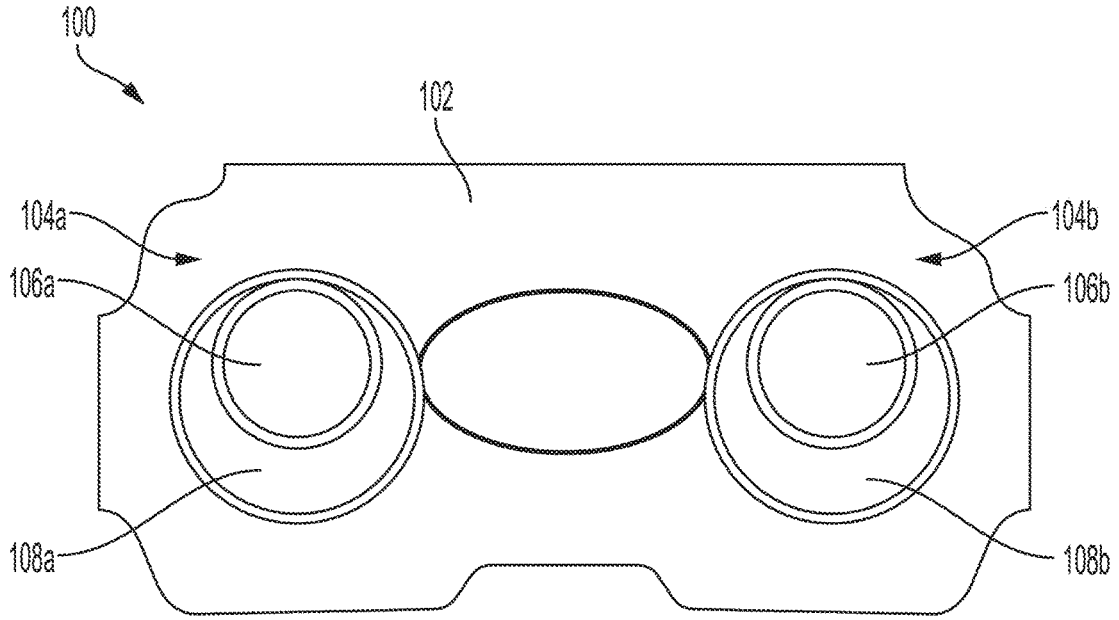
FIGS. 1A and 1B illustrate a front view and perspective view, respectively, of a preset for a saw chain that includes oriented, non-concentric rivets, in accordance with some embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

Call-outs for components that are present in multiples may be numbered identically, with a letter suffix distinguishing each instance of the multiple component. For example, where a component 102 is present multiple times in a figure, each instance of component 102 may be designated 102*a*, 102*b*, 102*c* . . . 102*x*. Referring to a component by its call-out without the letter, e.g. component 102, should be understood to refer to any or all instances of component 102*a*-102*x*, while reference to a specific instance of a component 102 will include its letter, e.g. component 102*b*.

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Figure 2A:
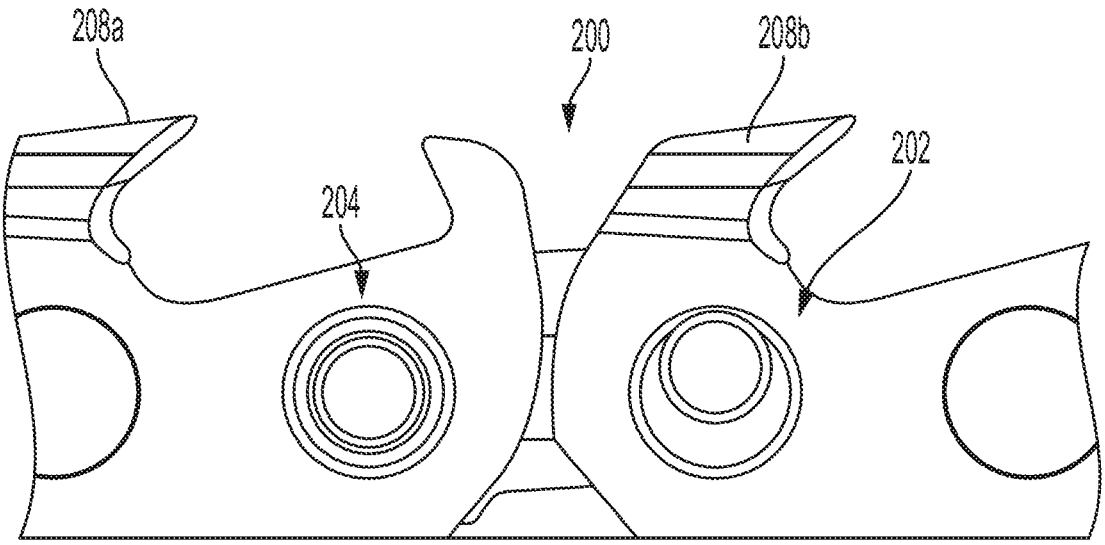
FIGS. 2A and 2B illustrate front and rear views of a preset including a concentric and a non-concentric rivet, in accordance with some embodiments.
Figure 2B:
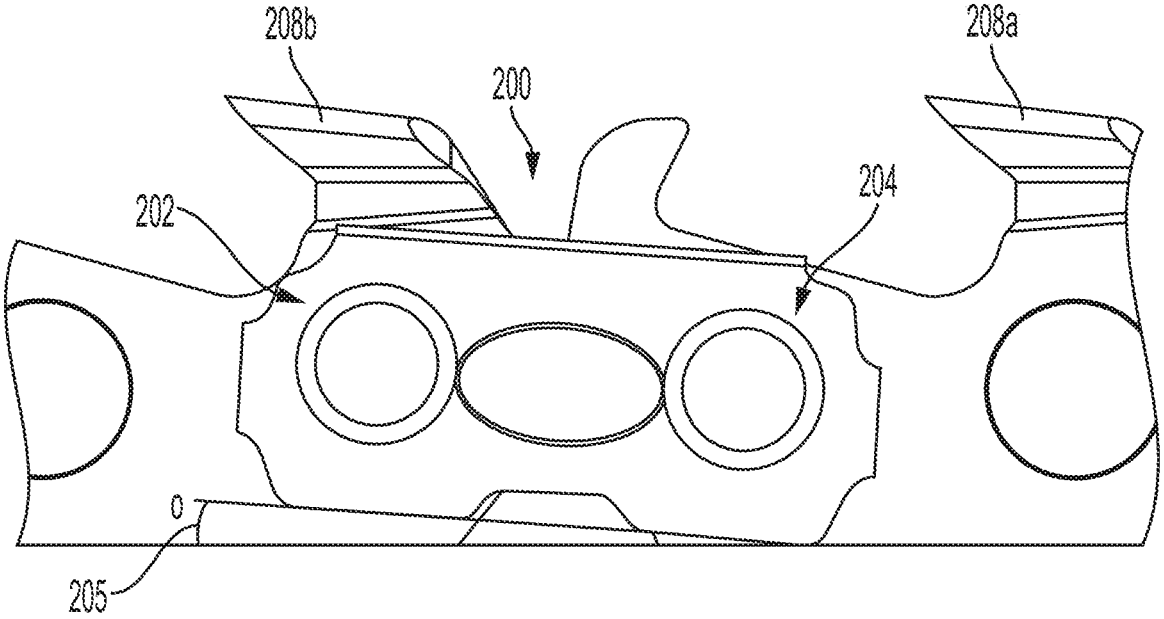
Figure 20A:
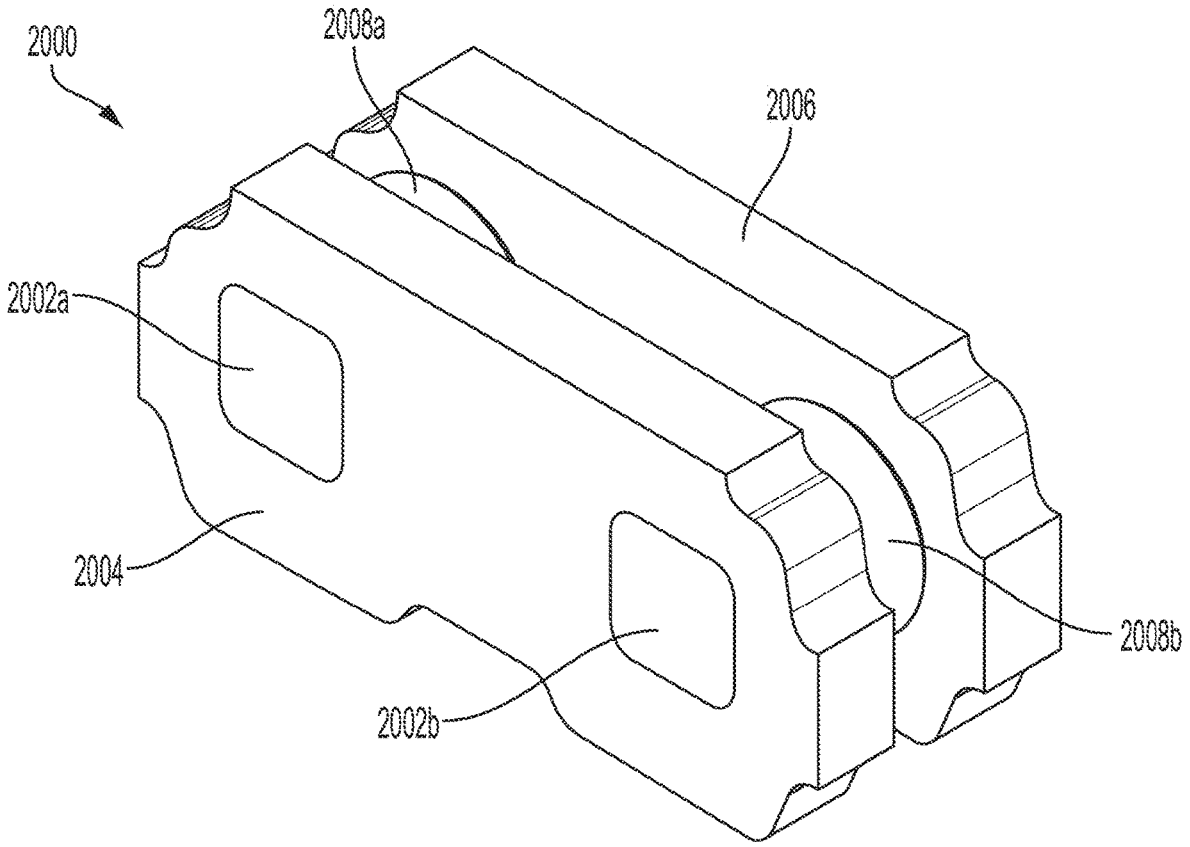
FIGS. 20A and 20B are perspective and partial front views of a fully assembled preset with rivets with rounded square hubs, according to still other embodiments.

Throughout this application, the term "preset" is used. A preset, as will be understood by a person skilled in the relevant art, may be comprised of one or more rivets that can be mechanically connected to one or more tiestraps. The nature and method of the mechanical connection will be discussed in detail herein. Each tiestrap itself may be an essentially flat, approximately rectangular piece of material that includes holes for receiving the one or more rivets. Each rivet may be double-ended, comprising a first end that is inserted into a first tiestrap, a second opposite end that is inserted into a second tiestrap, and a centrally located body disposed between the first and second ends. In certain embodiments, each end may be spun into a formed head to help secure the rivet to the tiestrap. Each preset may be used to form a link in a saw chain, tying together cutting elements. For example, a given preset may include two rivets, as depicted in the Figures. Each of the rivets may be passed through a cutting element so that each cutting element encompasses a flange associated with each rivet. A corresponding tiestrap may be placed over the exposed hubs of the two rivets, and the exposed hub ends may be coupled to the corresponding tiestrap, for example it may be spun to close/fix the chain and capture the cutting elements. FIGS. 2A and 2B depict the positioning of a preset to tie two cutting elements together, and FIG. 20A depicts a preset (albeit apart from the cutting elements) that has been coupled with a corresponding second tiestrap.

Chain saws may specify a particular configuration of the various components of its associated saw chain. The geometries of the saw bar and various drive and driven sprockets may dictate that presets comprising the saw chain possess specific dimensions. For example, the size of a tiestrap of a preset and the location of rivet flanges with respect to the edges of the tiestrap may be sized to meet a specified chain tension and play. The saw chain itself typically runs along a bar, between a drive sprocket that is driven by the chain saw's motor, and a sprocket located at the tip of the bar which may help retain the saw chain and smoothly guide it around the bar tip.

Even where a saw chain that meets required specifications is used, the saw chain and its constituent components are nevertheless subject to normal wear and tear during the course of operation. The total lifespan of a given saw chain is dependent upon a number of factors, which can include the amount of material provided by each preset upon assembly, as well as the type and hardness of the materials used to construct and assemble the preset. These material characteristics, such as the hardness of the materials when metal is employed, can be altered by selective use of heat treatments to obtain a desired hardness and/or ductility. Within a preset, different areas of the preset will be subject to different types of forces, e.g. tension, compression, shearing, as well as different degrees of friction, e.g. bearing surfaces vs. non-bearing surfaces, etc. Employing techniques that allow for selective hardening of different portions of a preset allows, in embodiments, optimization of a preset design to exhibit necessary hardness and wear resistance for high-friction points (but which may be at the expense of brittleness and diminished ductility), while retaining or enhancing the ductility and elasticity of other portions that are subject to relatively little friction, but instead are placed under a greater tension.

By employing selective hardening techniques combined with various brazing, soldering, and/or welding techniques, the disclosed saw chain presets can enable construction of saw chains that have a greater longevity and/or improved tolerance for wear and tear. The disclosed presets may also provide varying geometries to allow saw chains to be better engineered for intended purposes, and may yield better performance over currently known saw chains.

Figure 1B:
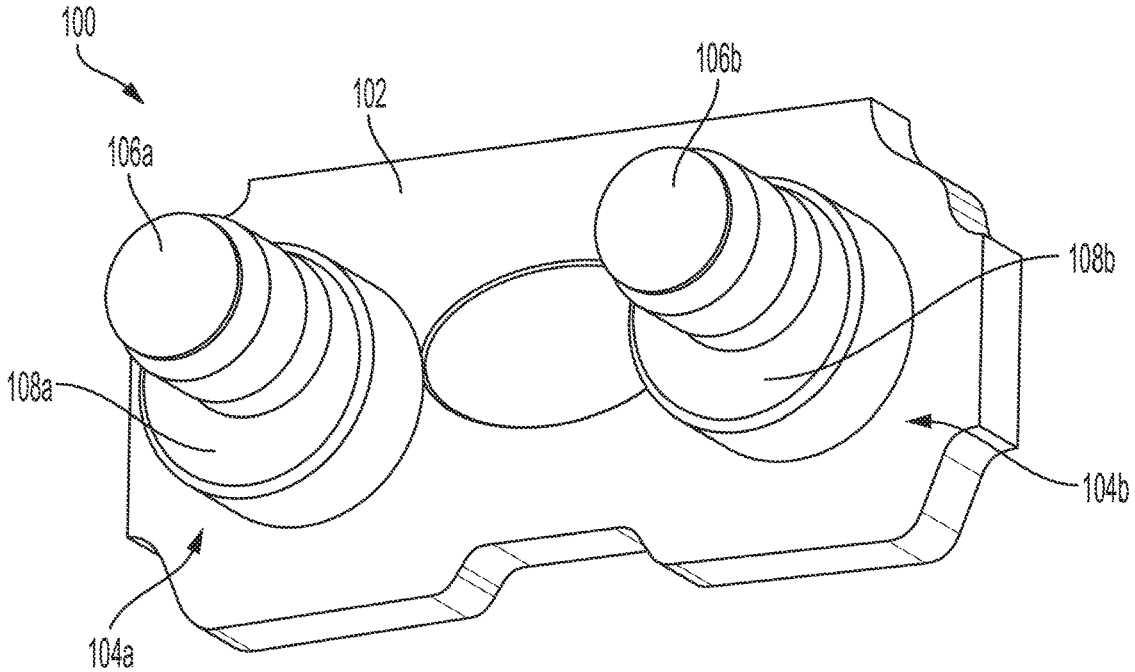

FIG. 1A and 1B depict a preset 100 with oriented, non-concentric rivets 104*a*, 104*b* (collectively, 104), according to some embodiments. The non-concentric rivets 104 are positioned into a tiestrap 102. In the depicted embodiment, each rivet 104 has a non-concentric hub 106*a*, 106*b* with respect to each rivet's 104 flange 108*a*, 108*b*. Preset 100 may be assembled so that each flange 108 is positioned in a similar position with respect to tiestrap 102 as a preset assembled with conventional rivet. However, the non-concentric hub 106 of each rivet 104 may allow each rivet hole in tiestrap 102 to be positioned with a greater or lesser distance from the heel of tiestrap 102 as compared to a preset that uses rivets with hubs that are concentric to their flanges.

In some embodiments, tiestrap 102 is substantially planar in shape, and is configured to accept two rivets via a corresponding pair of holes, each sized to accept each rivet hub 106, but not allow each rivet's flange 108 to pass through. Tiestrap 102 may be constructed from any material suitably durable to withstand the forces experienced by a saw chain in use, which is typically steel or a similarly durable alloy, or another type of durable metal. The selected material may be capable of selective hardening, discussed in greater detail herein. However, other materials that are suitably durable may be employed in other embodiments. Tiestrap 102 will be discussed in greater detail herein.

In embodiments, each rivet 104 may be substantially cylindrical in shape, defined by a central flange 108 that is disposed between a hub 106 on either end, in an orientation that is axial or, in the case of rivets with a non-concentric hub and flange, parallel to each rivet's longitudinal axis. Rivet 104 may be constructed from any material that is suitably durable to withstand the forces experienced by rivet 104 during the normal use and operation of its associated saw chain, including metals and alloys such as steel. As will be described in greater detail below, rivet 104 may be formed as a single piece in some embodiments. In other embodiments, rivet 104 may be comprised of a single central hub 106 that passes through flange 108, as will be described with reference to FIG. 18.

Figure 1C:
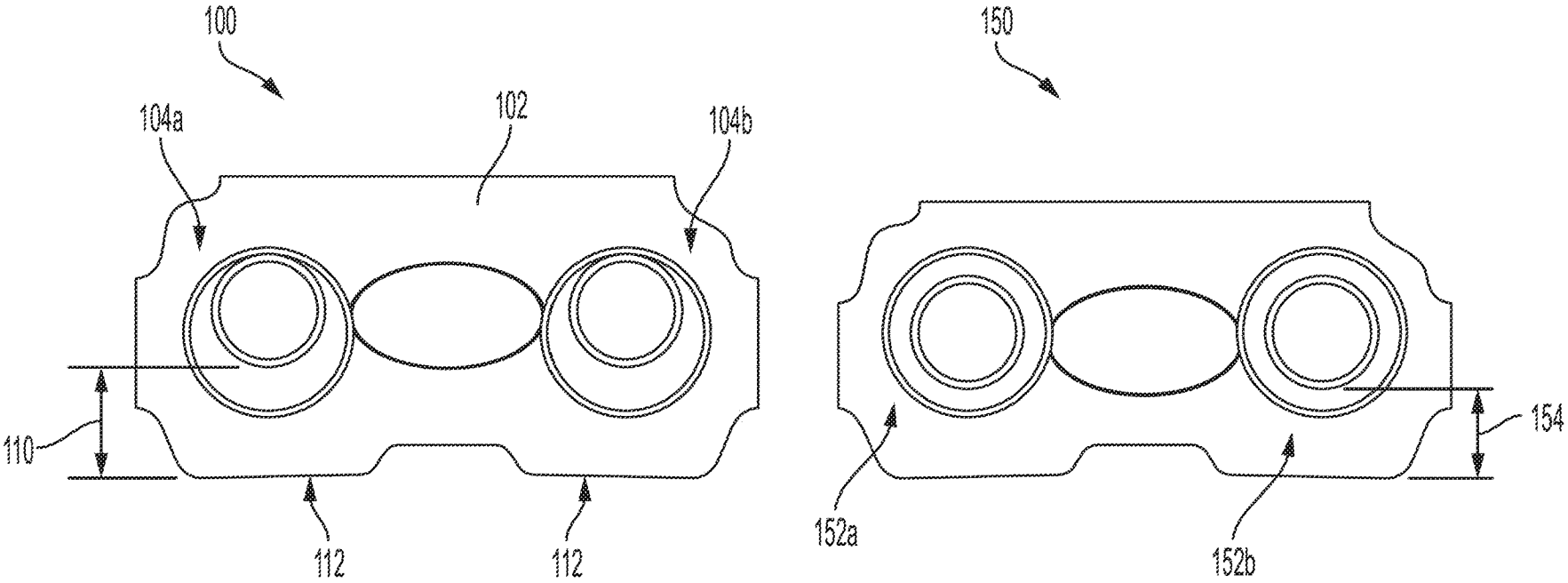
FIG. 1C illustrates the front view of the preset of FIG. 1B, in comparison with a preset assembled with concentric rivets, according to some embodiments.

As can be seen in FIG. 1C, the use of non-concentric rivets 104*a*, 104*b* with preset 100 results in a greater amount of material 110 between the heel 112 of tiestrap 102 and each rivet hole (behind each rivet flange) when compared with the material 154 on a preset 150. Preset 150 is configured to be used with conventional, concentric rivets 152*a*, 152*b*. In the embodiment depicted in FIG. 1C, preset 100 and preset 150 each have their respective rivet flanges at approximately the same distance from the heel 112 of each tiestrap. However, by using rivets 104*a*, 104*b* with non-concentric hubs, the receiving rivet holes on tiestrap 102 may be placed further away from heel 112 while still maintaining the flange of each rivet 104 in an optimal position, thereby providing the greater amount of material 110 compared to material 154 on preset 150, which uses concentric rivets 152. The greater amount of material, in turn, provides for a longer-lasting tiestrap 102, as a greater amount of material may be worn from the heel 112 of tiestrap 102 during normal use while still maintaining the integrity of tiestrap 102 and delaying the possible formation of cracks that would render preset 100 unusable.

Referring to FIGS. 2A and 2B, other embodiments may employ a mix of non-concentric rivets with conventional concentric rivets. Preset 200 includes one non-concentric rivet 202 and a concentric rivet 204. The result may be a preset 200 that may be pulled to an angle 205 in a saw chain when tensioned. This angle 205, determined at least in part by the degree to which the hub of non-concentric rivet 202 is offset from the central axis of the flange of rivet 202, may be configured to place cutters 208*a* and 208*b* on a drive link at an angle 205 that will maximize the thickness of the chip of removed material from the work piece, particularly when the saw chain is under sufficient tension. Insufficient tension may cause the cutters 208*a*, 208*b* to be located in a less-than-optimal position, reducing chip size and cutting effectiveness. At least one non-concentric rivet 202 may angle the preset 200 to maximize the speed and cutting efficiency of the saw chain. The body of each cutter 208*a* and 208*b* includes a hole sized to fit around the flange of rivets 202 and 204, as shown in FIG. 2A. The chain depicted in FIGS. 2A and 2B could then be closed by installing a tiestrap over the hubs of rivets 202 and 204, depicted in FIG. 2A, and spinning each hub, for example, to form a rivet head that secures preset 200 in place, much as is seen in FIG. 2B, which shows the rivet heads spun and formed from the hubs of rivets 202 and 204.

Figure 2C:
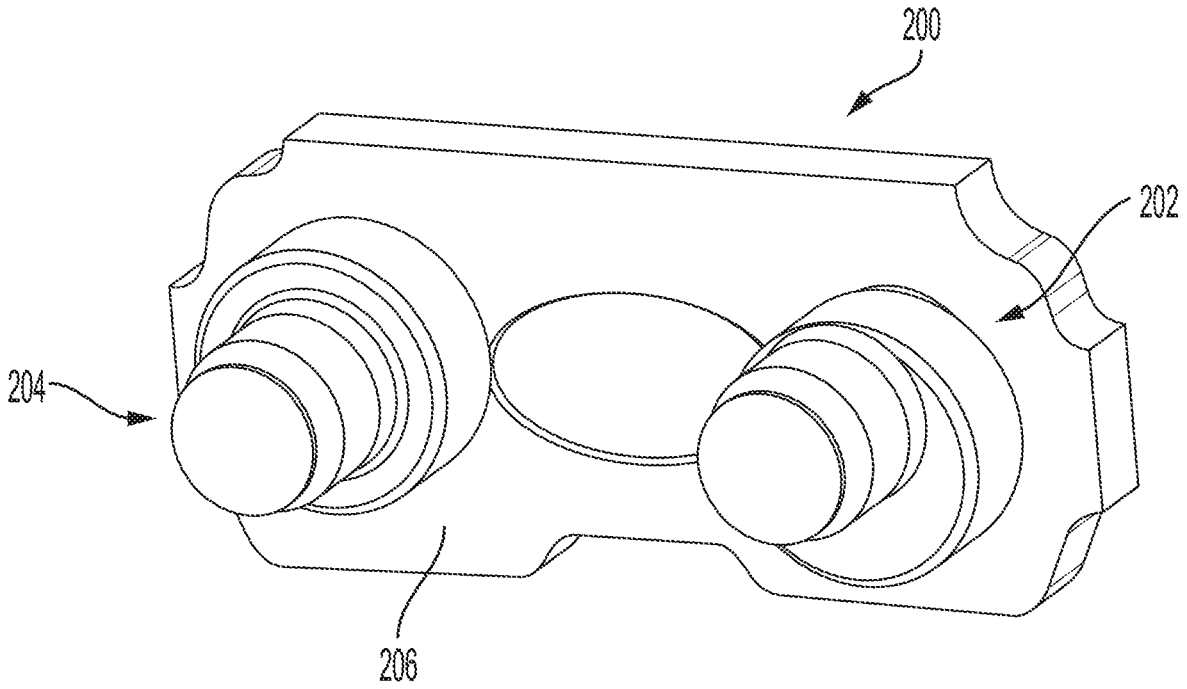
FIGS. 2C and 2D illustrate perspective and front views of the preset of FIGS. 2A and 2B apart from the chain, in accordance with some embodiments.
Figure 2D:
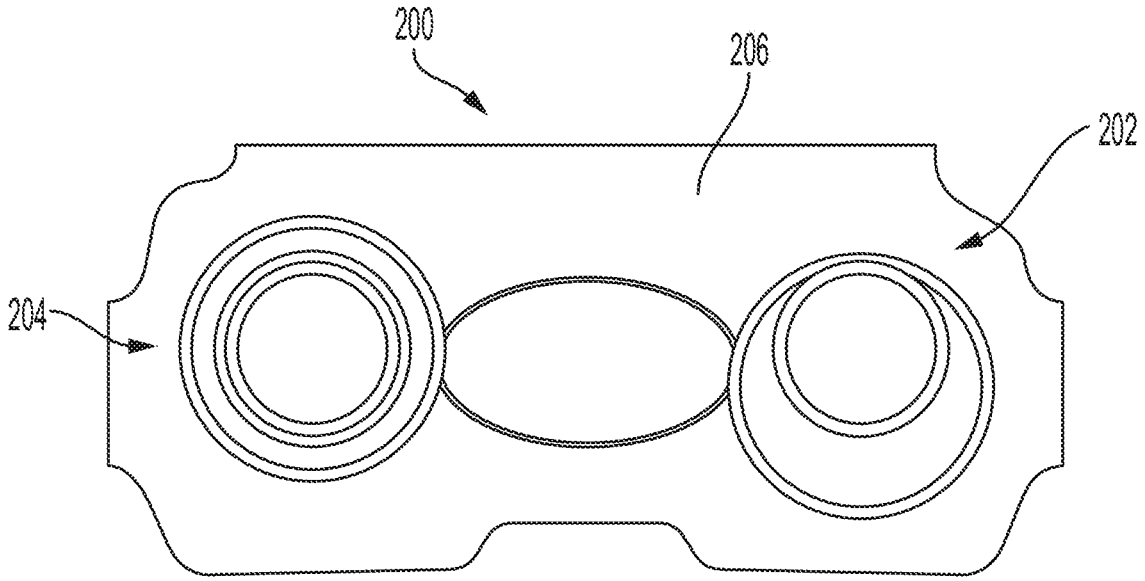

FIGS. 2C and 2D show preset 200 apart from cutters 208*a* and 208*b*, to demonstrate the position of each rivet 202 and 204 with respect to tiestrap 206. As the rivet holes on tiestrap 206 are substantially parallel, similar to the rivet holes on tiestrap 102 on preset 100, the use of one non-concentric rivet 202 and one concentric rivet 204 results in the flange on rivet 202 being offset from the flange on rivet 204. This offset results in preset 200 pulling to angle 205 when a tension is applied across the flanges of rivets 202 and 204 that is parallel with a line formed by the hubs of rivets 202 and 204.

Figure 3A:
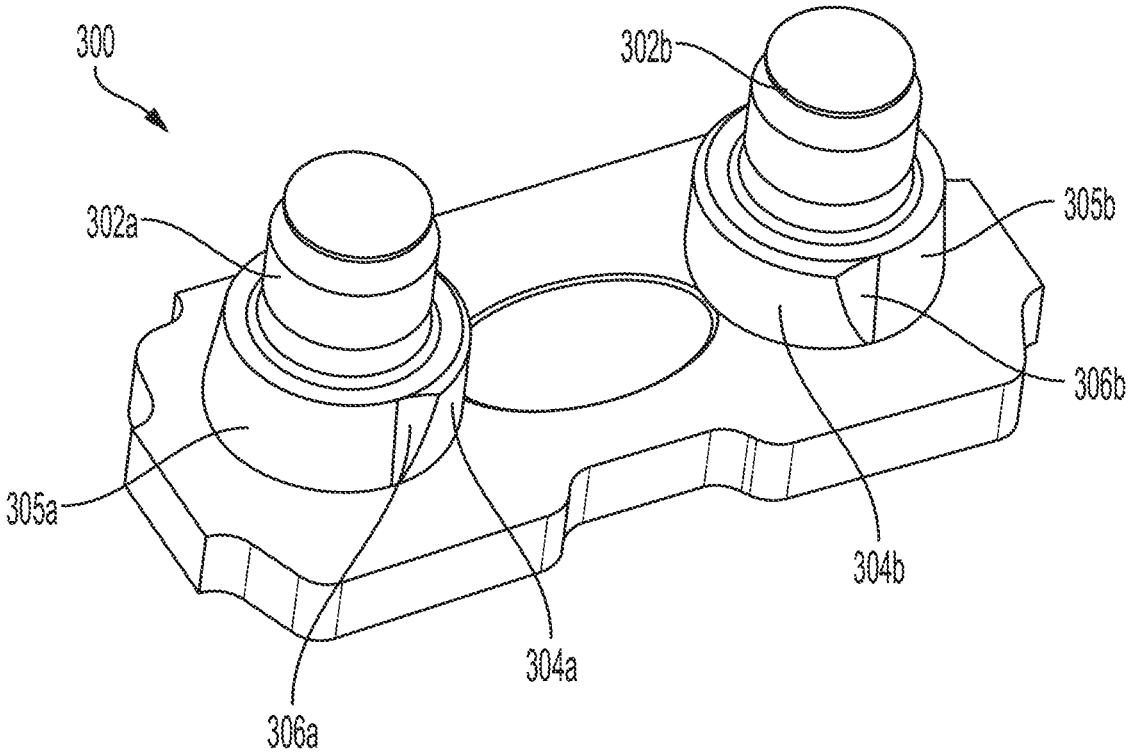
FIGS. 3A and 3B illustrate top perspective and side views of a preset where each rivet flange is non-symmetrical, in accordance with some embodiments.
Figure 3B:
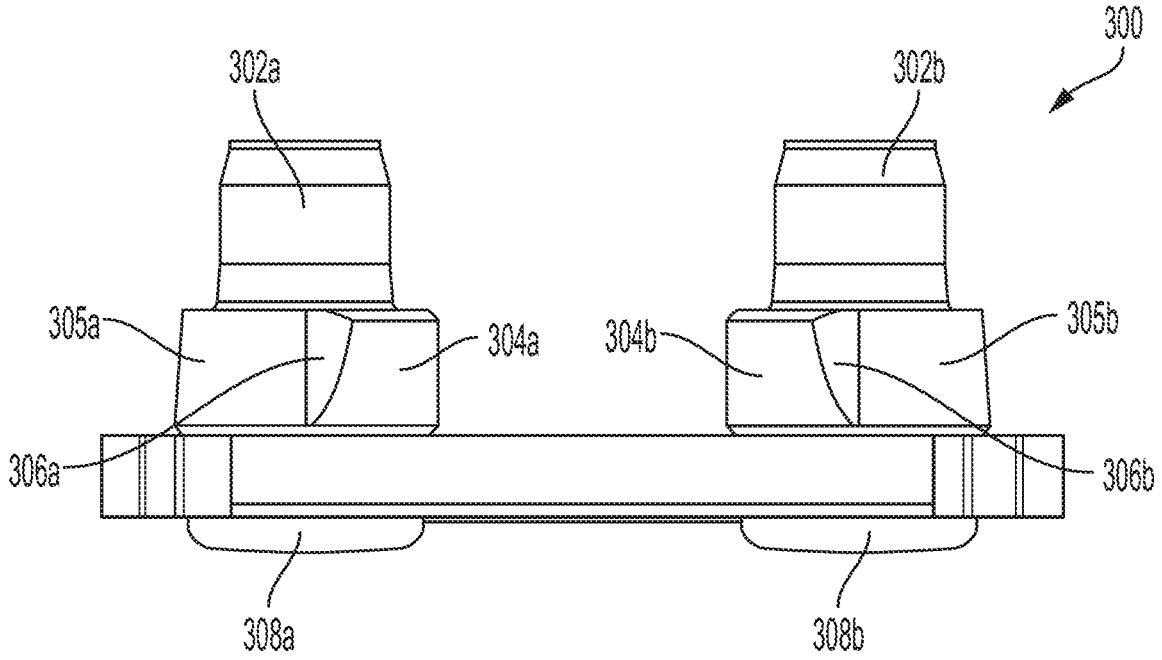

Referring to FIGS. 3A and 3B, presets 300 with rivets 302*a*, 302*b*, each with non-symmetrical flanges, are depicted. Each flange may include an inner bearing surface 304*a*, 304*b*, an outside surface 305*a*, 305*b*, and a lip 306*a*, 306*b* that is disposed upon each respective flange radially from each rivet's 302 hub, and serves as a separation between inner bearing surfaces 304 and outside surfaces 305. Also seen in FIG. 3B in profile view are spun heads 308*a*, 308*b* of rivets 302*a* and 302*b*, respectively. Lip 306 on each rivet 302 may serve several purposes, including creating an oil reservoir in connection with outside surfaces 305*a*, 305*b*, which are drafted at an angle to retain bar/chain oil for a chain saw's oiling mechanism. As the chain moves across and around the chain saw bar, the various components and links of the saw chain rotate with respect to each other, including the cutters rotating about their respective rivets 302*a*, 302*b*. Chain tension brings the cutters into contact with inner bearing surfaces 304*a*, 304*b* of rivets 302. Surfaces 304*a* and 304*b* may face each other and, when the chain is tensioned, these surfaces 304*a*, 304*b* typically absorb the bulk of the tension load. As will be described further herein, inner bearing surfaces 304*a* and 304*b* may be hardened to better withstand any wear imposed by this tension load. This rotation is facilitated by the bar oil, which also may serve to substantially reduce chain wear and prolong chain life by creating a film on the flange bearing surfaces 304 to keep the metal of the various links from coming into direct contact with each other, resulting in wear from friction. Thus, lip 306 facilitates oil retention in various embodiments, to ensure the oil film on the flange bearing surfaces 304*a*, 304*b*, does not dissipate during saw usage.

In some embodiments, the lips 306*a*, 306*b* also assist in the assembly of preset 300, by serving as an index or notch for assembly equipment or personnel to properly orient each rivet 302. As will be appreciated by a person skilled in the relevant art and will be demonstrated in greater detail below, non-concentric and non-symmetric rivets may need to be positioned in a particular or specific orientation with respect to a tiestrap. For example, referring to FIGS. 2A to 2D, non-concentric rivet 202 should be oriented with the bulk of its flange disposed lower (away from cutter 208) than the flange of concentric rivet 204, to allow preset 200 to achieve the correct angle 205 as depicted in FIGS. 2A and 2B. Orienting non-concentric rivet 202 so that the bulk of its flange is closer to cutter 208, or so that the bulk of the flange is biased in the direction of concentric rivet 204, will result in preset 200 being improperly oriented to achieve angle 205. The presence of a lip 306 as well as drafted outside surfaces 305 on a rivet 302 may assist assemblers, tooling or automated assembly equipment in achieving this correct orientation of each rivet 302.

Figure 4:
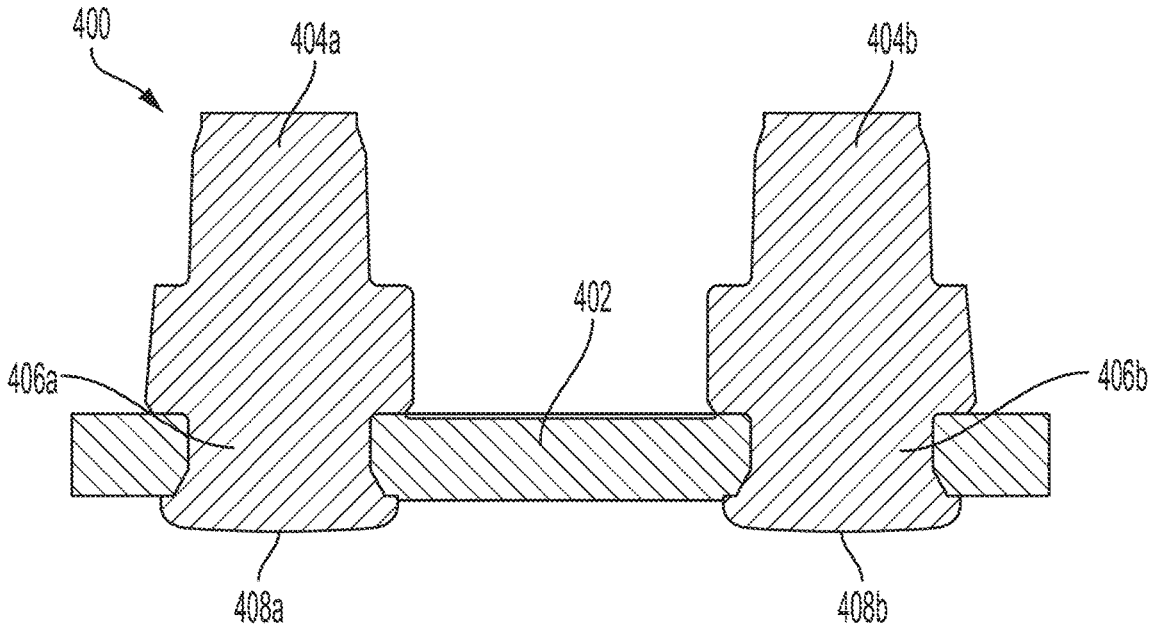
FIG. 4 illustrates a cross-sectional view of the preset of FIG. 3B, in accordance with various embodiments.

FIG. 4 depicts a preset 400 in cross-section. In the depicted embodiment, rivets 404*a* and 404*b* use the same non-symmetric flanges as preset 300. The configuration of tiestrap 402 with respect to rivets 404 is shown, with one of each hub 406*a*, 406*b* being passed through a corresponding hole on tiestrap 402. The ends of each hub 406 may be spun to rivet heads 408*a* and 408*b*, thereby securing each rivet 404 to tiestrap 402. The rivet heads 408 may be spun or formed by any suitable process now known or later developed, such as by pressing or hammering, or the heads not be present and the rivets may be otherwise secured to the tiestrap 402 such as discussed further below.

Figure 5A:
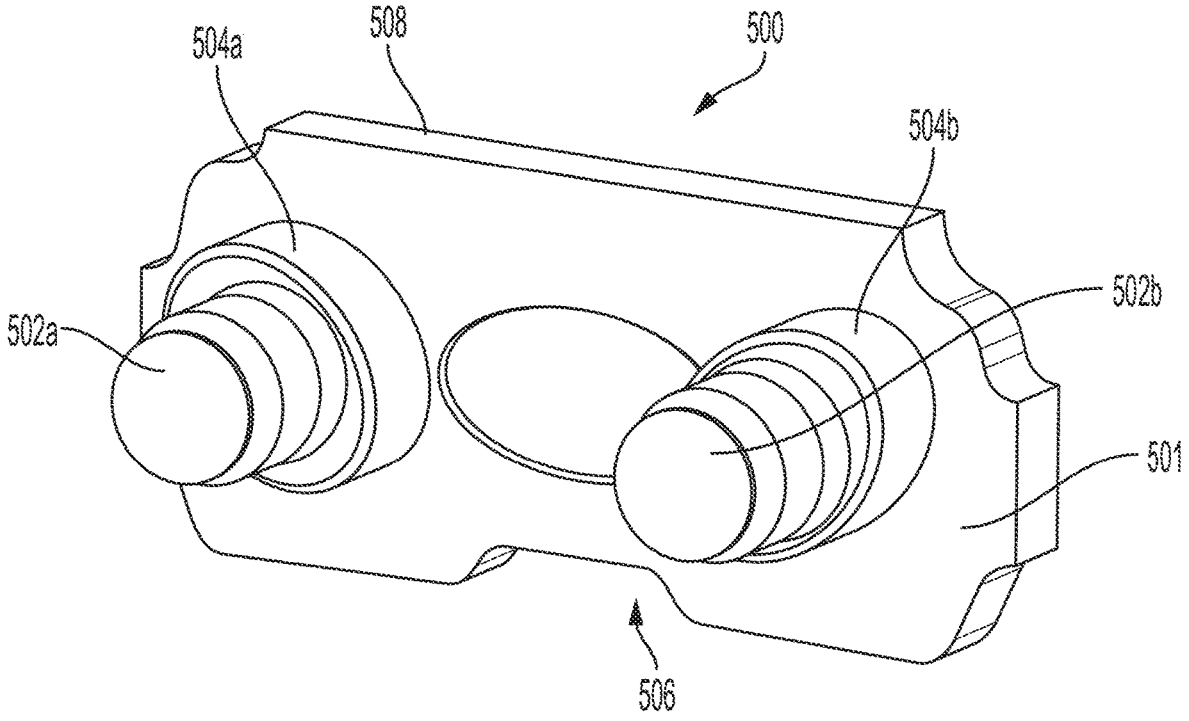
FIGS. 5A through 5D illustrate a perspective and several front views of presets with ovoid rivet flanges, with the rivets in various orientations, in accordance with some embodiments.
Figure 5B:
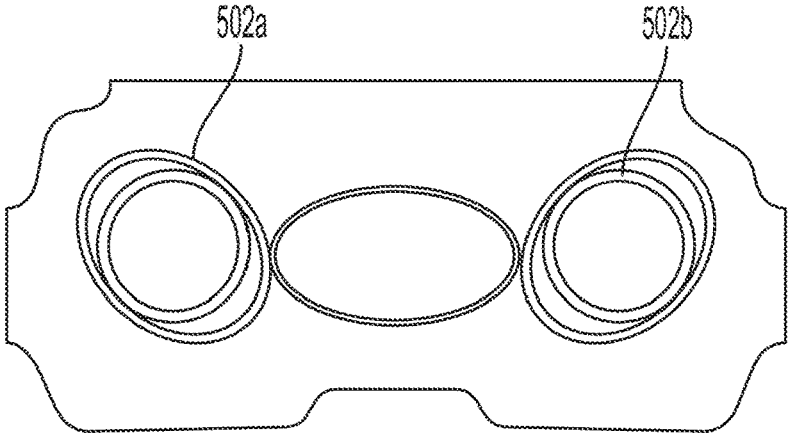
Figure 5C:
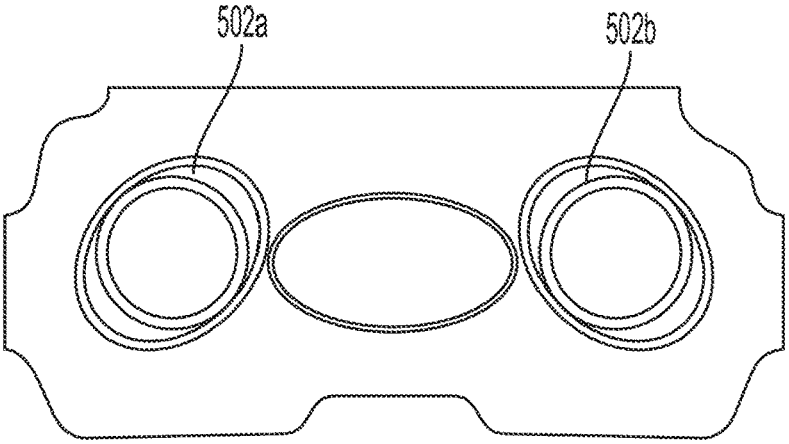
Figure 5D:
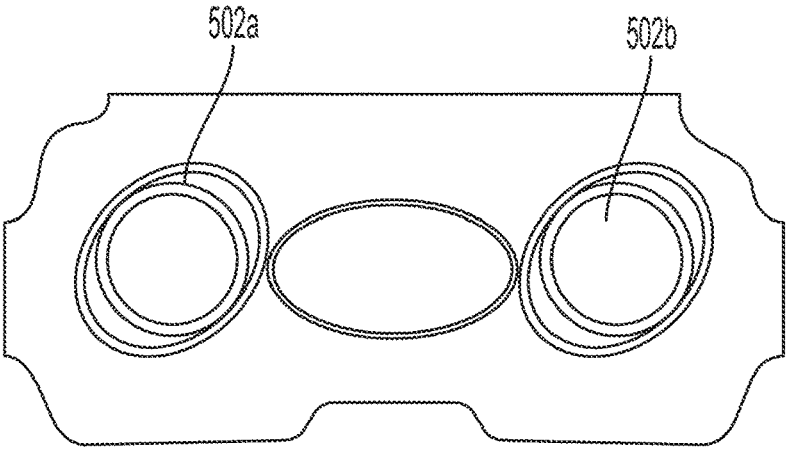

FIGS. 5A to 5D depict a preset 500 that includes rivets 502*a* and 502*b* that each include a flange 504*a*, 504*b*, respectively, that is ovoid or elliptical in shape, with long and short axes. Rivets 502*a* and 502*b* may thus be oriented with respect to each other, referring to each flange 504's long and short axes, in a variety of positions. FIGS. 5B to 5D depict three possible arrangements. FIG. 5B, as can be seen, orients each rivet 502 so that the long axis of each associated flange is angled toward each other in the direction of the center of notched edge 506 of tiestrap 501. FIG. 5C depicts the opposite, where the long axis of the flange of each rivet 502 is angled toward each other in the direction of the center of the smooth edge 508. FIG. 5D orients the long axis of the flange of each rivet 502 to be substantially parallel to each other. The ovoid shape of each flange 504 may provide a camming effect in various saw chains that may provide useful characteristics or functionality to the saw chain. It will also be recognized that the flange orientations in each embodiment of FIGS. 5B to 5D are arbitrary. Rivets 502 and corresponding flanges 504 may be oriented in any arbitrary position with respect to each other, possibly subject only to limitations imposed by the intended use of the saw chain using preset 500.

In some embodiments, such as where each rivet 502 is separate, and not formed from tiestrap 501, tiestrap 501 may include holes for setting each rivet 502 that establish the orientation of each rivet 502. In such embodiments, the holes may be of an ovoid shape that matches the ovoid shape of each flange 504, ensuring that each rivet is positioned and locked into a desired orientation. In other embodiments, tiestrap 501 may employ round holes, with each rivet having a round portion below each flange 504. The orientation of each rivet may then be set prior to forming a head on each rivet 502, brazing or soldering each rivet 502, or otherwise securing each rivet 502 in tiestrap 501 in a fixed position. Still other embodiments may allow each rivet to rotate within each hole in tiestrap 501, where allowing the orientation of each rivet to vary or dynamically adjust is desired.

Figure 6A:
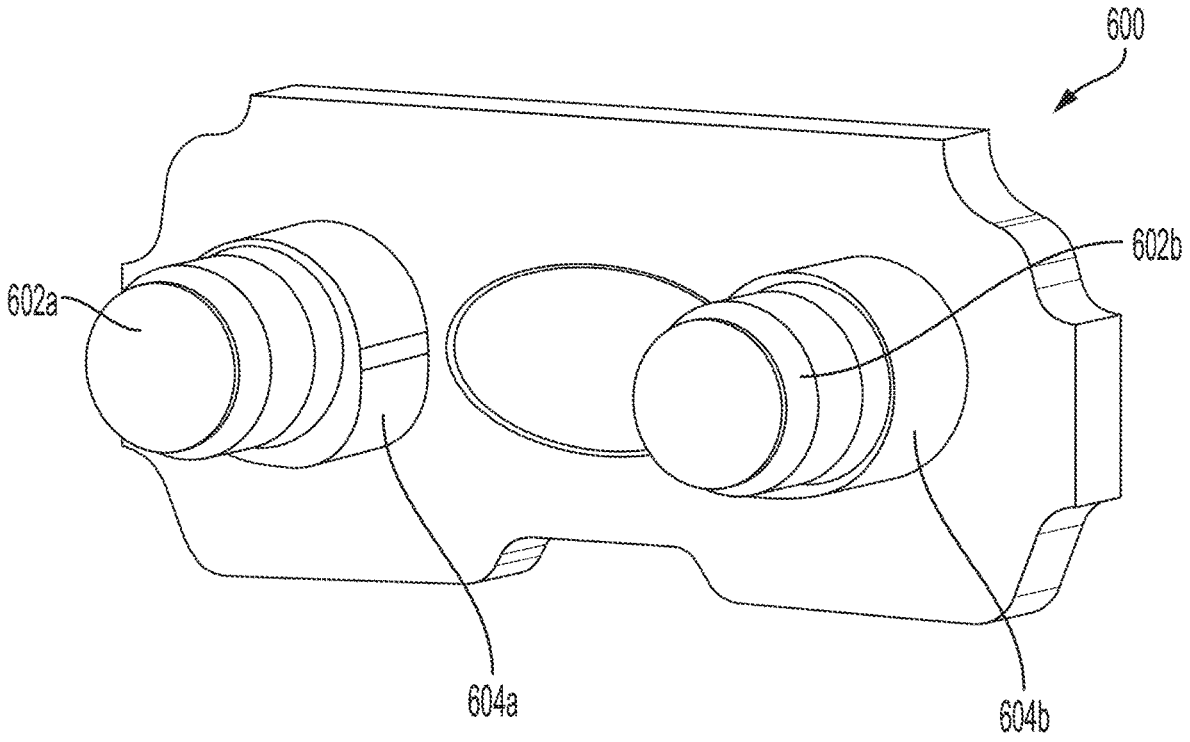
FIGS. 6A and 6B are perspective and front views of presets with cam-shaped rivet flanges, in accordance with some embodiments.
Figure 6B:
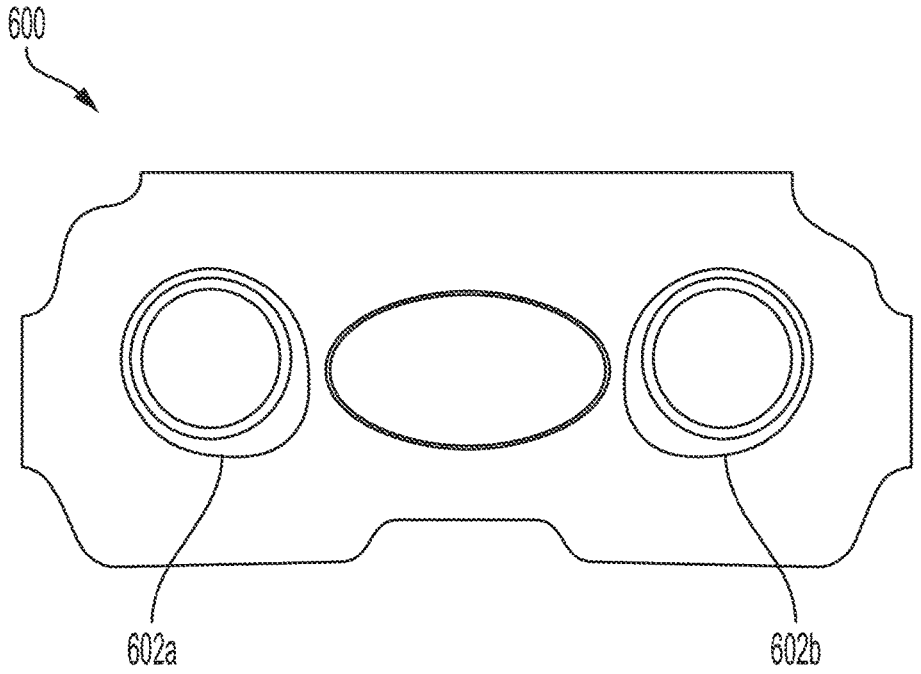

FIGS. 6A and 6B depict yet another variant of preset 600, which uses rivets 602*a* and 602*b* that each possess a cam-shaped flange 604*a*, 604*b*, respectively. The shape of each flange 604 as a cam, or as an ovoid with respect to FIGS. 5A to 5D, may allow the orientation of various saw chain parts to vary as the saw chain travels around the chain saw bar. The orientation may transition as the saw chain traverses from the straight portion of the bar rails to the nose sprocket, and vice-versa. Alternatively or additionally, cam or ovoid-shaped flanges may allow part orientation to change as the saw chain load changes. Increasing loads may increase tension on the saw chain, which in turn will pull components against the ovoid or cam-shaped flanges and result in orientation shifts, similar to how the angled preset 200 may cause cutters 208 to shift angles and improve cutting performance. Other advantages that may be realized with presets 200, 500 and 600 include better clearing of chips and other debris from the saw chain during use, possible reorientation of cutters for application of an automatic sharpening mechanism with which a chain saw may be equipped, and/or other various advantages that may be recognized in the relevant art. As with preset 500, the holes securing each rivet 602 into the corresponding tiestrap may be round or match the cam shape of each flange 604, depending upon the needs of a given embodiment.

Preset components such as rivets and tiestraps can be hardened using various metalworking techniques, such as heating and quenching. Some heating techniques use induction coils, which can be shaped to a specific part, and further can be engineered to only heat specific portions of a part, thereby facilitating selective heating. By employing selective heating, portions of a rivet and/or tiestrap can be provided with specific desired hardnesses. Where a rivet or tiestrap includes portions that need to be of a softer hardness, such as portions that must be deformable to form rivet heads, softening techniques may not be suitable, as the necessary heat treatment to obtain a softer metal will significantly affect nearby areas that require a greater hardness. Other suitable techniques now known or later developed may be employed to selectively harden presets and/or various preset components.

Figure 7:
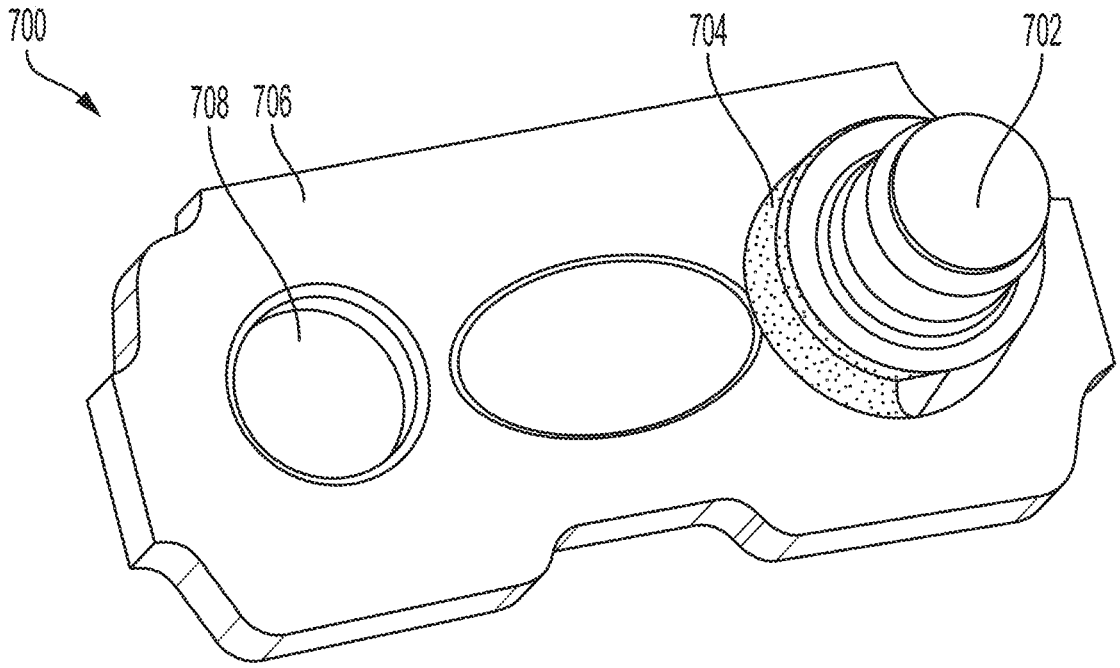
FIG. 7 is a perspective view of a preset with a single rivet that has had a portion of its flange selectively hardened, according to various embodiments.

FIG. 7 depicts a preset 700 that, in embodiments, may include a rivet 702 that has selectively hardened portions, such as a portion of flange 704, to improve its use in a saw chain, such as by increasing the durability of rivet 702 in normal wear and tear. Preset 700 may include a tiestrap 706, as well as a second rivet hole 708 to accept a second rivet, as demonstrated with respect to the embodiments depicted in the previously discussed figures. It will be appreciated by a person skilled in the relevant art that flange 704 is depicted as selectively hardened in a location likely to bear most of the tension stress from components such as the above-described cutters. Such a location may thus be the most susceptible to wear, and selective hardening may improve the longevity of rivet 702 (and by extension, preset 700 and ultimately the entire saw chain). The remainder of rivet 702 as well as tiestrap 706 may be at a lesser, base hardness.

Selective hardening, such as the hardened portion of flange 704, may be employed to facilitate assembly. As is known in the art, hardening of a metal may likewise result in a loss of ductility and an increase in brittleness, with some hardened metals more likely to fail by cracking, as opposed to a more plastic deformation. Hardened metal may also not be suitable for subsequent formation into a rivet head for saw chain assembly. It may not be desirable, then, to have the entirety of preset 700 at a single hardness that would enhance wear durability. Thus, having a preset 700 with various surfaces of different (e.g. higher or greater) hardnesses for specific wear locations, while retaining a lower, more malleable hardness on the remainder of preset 700, may result in a preset 700 that achieves an optimal balance. Surfaces subject to high loading and high friction may be preferably hardened, while the remainder is left more ductile. The greater ductility can facilitate the spinning of rivet heads and allowing the saw chain some degree of elasticity to absorb changing tensions during use without deforming or forming stress cracks. Moreover, selective hardening only of those portions that need greater hardness can reduce energy usage during manufacture by not requiring the entirety of preset 700 to be heat treated.

Figure 8:
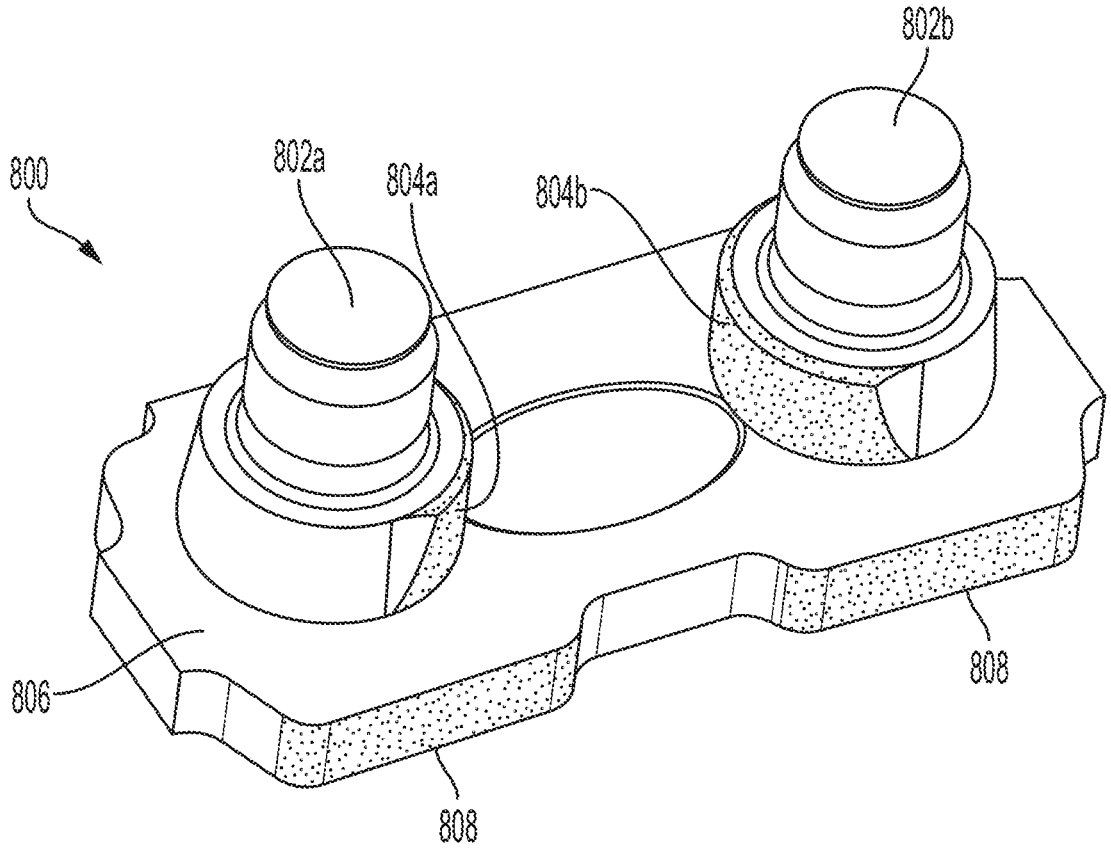
FIG. 8 is a perspective view of a preset with two rivets, where a portion of the flange of each rivet and a portion of the tiestrap's heel have been selectively hardened, according to various embodiments.

FIG. 8 shows a preset 800 with two rivets 802*a*, 802*b*. As with preset 700, rivets 802*a* and 802*b* each include a flange with a hardened portion 804*a*, 804*b*, respectively. The hardened portions 804 face each other, located where rivets 802 of preset 800 are expected to experience the greatest wear from saw chain tension and movement during use. Also seen in FIG. 8 are selectively hardened heel portions 808 of tiestrap 806. Each heel portion 808 is hardened to the same hardness as flange hardened portions 804, as each heel portion may contact the chain bar rails and be subject to greater wear. This, hardening the heel portion 808 improves the overall wear and longevity of the saw chain. Further, it should be appreciated that hardening heel portion 808 may be used on the tiestrap of preset 200, which uses concentric and non-concentric rivets to angle the preset, and consequently brings a portion of the heel of the tiestrap into more frequent contact with the chain bar. A hardened heel portion 808 may offer greater longevity in such an implementation.

Figure 9:
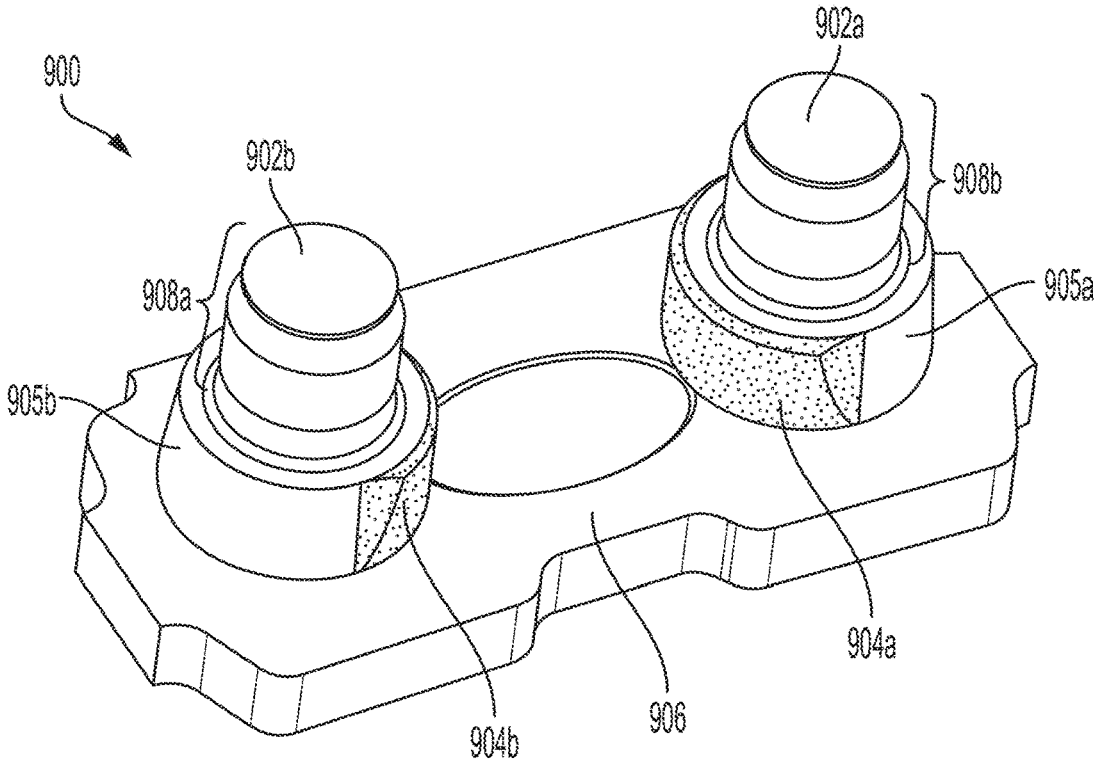
FIG. 9 is a perspective view of a preset with portions of each rivet flange selectively hardened to a first hardness, and the remainder of each rivet and the tiestrap selectively hardened to a second hardness, according to some embodiments.

In another embodiment, FIG. 9 depicts a preset 900 with rivets 902*a* and 902*b* inserted into tiestrap 906. As with FIGS. 7 and 8, each rivet 902*a*, 902*b* has a selectively hardened portion 904*a*, 904*b*, respectively, with each portion 904*a*, 904*b* facing each other. Portions 904*a* and 904*b* are hardened to a first hardness. Preset 900 further has remaining flange portions 905*a* and 905*b*, along with tiestrap 906, that are hardened to a second hardness. Finally, rivets 902*a* and 902*b* have unhardened portions 908*a* and 908*b*, respectively, that remain at a base hardness. Thus, the overall hardness of preset 900 may be increased over a base level hardness of other presets. This increase in overall hardness may be desirable in some applications to limit the amount of stretch offered by preset 900 in response to a saw chain coming under load, to help ensure desired performance characteristics and more consistent chain tension.

Figure 10:
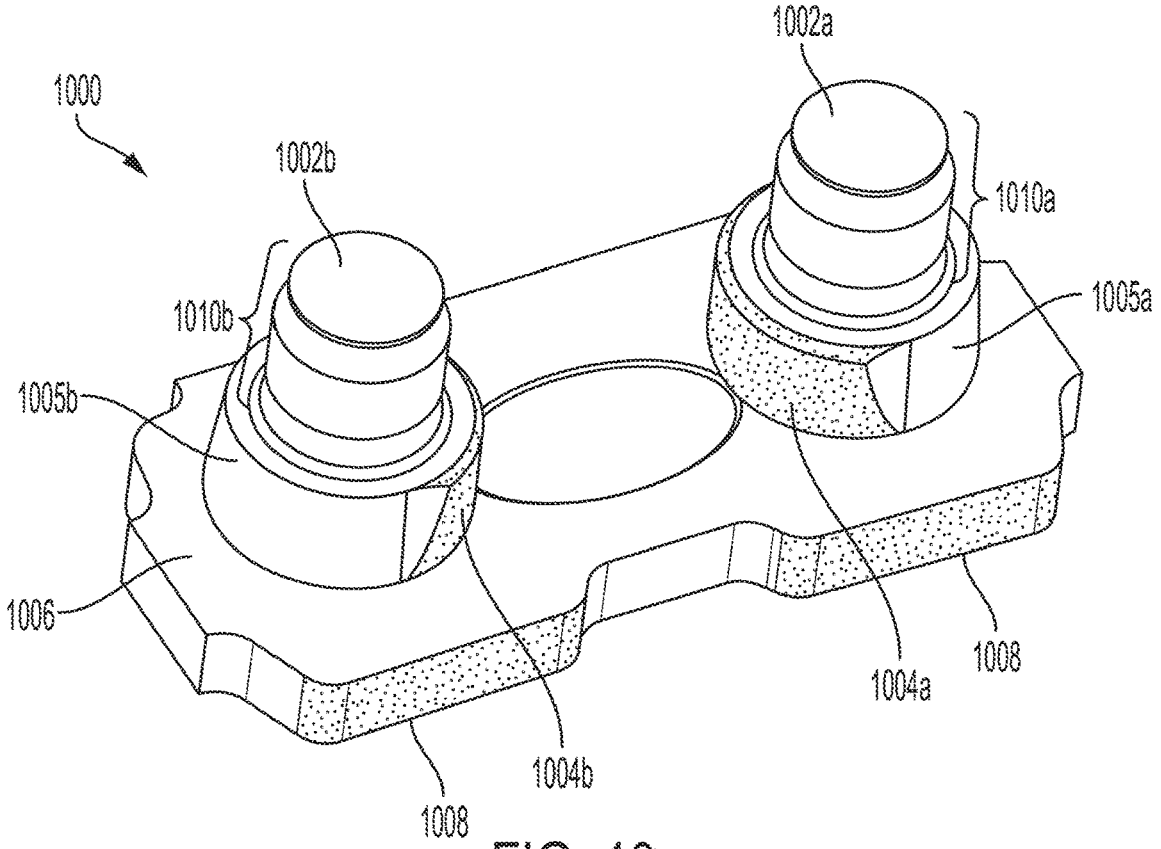
FIG. 10 is a perspective view of a preset with portions of each rivet flange and the heel of the tiestrap selectively hardened to a first hardness, and the remainder of each rivet and the remainder of the tiestrap selectively hardened to a second hardness, according to some embodiments.

FIG. 10 illustrates yet another embodiment with further areas selectively hardened. Preset 1000 includes rivets 1002*a* and 1002*b*, each configured similarly to rivets 902. Rivets 1002*a* and 1002*b* include portions 1004*a*, 1004*b* that are selectively hardened to a first hardness, remaining portions 1005*a*, 1005*b* selectively hardened to a second hardness, and hub portions 1010*a* and 1010*b* that remain at a base hardness. Rivets 1002 are inserted into tiestrap 1006, itself hardened to the second hardness. In contrast with preset 900, however, tiestrap 1006 also includes heel portions 1008 that are selectively hardened to the first hardness, similar to preset 800. Thus, preset 1000 offers greatest hardness and wear resistance in those areas most subject to wear and friction, an overall increase in hardness over base to limit the stretch and elastic characteristics of preset 1000, and a base hardness for hub portions 1010*a* and 1010*b*, allowing them to be easily spun into rivet heads.

Although not visible in the figures, the spun heads attaching rivets 1002 to tiestrap 1006 may be hardened to the second hardness following formation, in some embodiments. Likewise, once a second tiestrap 1006 is secured to preset 1000 upon chain assembly, the spun heads fixing the preset may likewise be hardened to a second hardness. This post-head hardening may increase rivet head strength and shear resistance, which may improve chain durability in various applications, such as cutting or when the chain experiences high tension, such as the result of high loading.

With respect to FIGS. 7 to 10, in some embodiments, the first hardness may have a hardness ranging from around 58-62 HRC (rockwell hardness), and may more particularly be around 60 HRC; the second hardness may have a hardness ranging from around 40-55 HRC, and may more particularly be around 52 HRC, and the base (unhardened) material may have a hardness ranging from around 20-45 HRC, and may more particularly be around 35 HRC. These values may be modified, along with the placement of areas of first or second hardness, depending upon a particular embodiment of a preset.

As may be appreciated from review of the foregoing FIGS. 1A to 10, where presets employ rivets with non-concentric flanges or ovoid flanges, each rivet is capable of an orientation with respect to its tiestrap. The orientation of each rivet may be critical to achieve a desired performance for a saw chain using such presets. In such applications, it may be critical that the rivet not rotate with respect to the tiestrap, which would result in the preset no longer functioning as intended. Presets in saw chains may be subject to extreme dynamic loading and vibration, which may induce rotation in a rivet that is not secured to the tiestrap. This rotation may be facilitated by the presence of bar oil. Various means, disclosed below, may be used to orient and/or secure a rivet to a tiestrap in a non-rotating, immovable fashion.

As will be described further below, methods of preventing a rivet from rotating within its tiestrap may include, in some embodiments, processes such as brazing or soldering, to bond the tiestrap and rivet together. Other embodiments may employ mechanical means, such as keyed or shaped tiestrap holes (discussed above briefly) and correspondingly shaped rivet hubs that prevent rotation. Still other embodiments may use a combination of any of the foregoing.

As a general principle, a brazing technique, which employs filler metal (sometimes referred to as braze) that flows by capillary action between two metal surfaces, may be employed where the clearances between a rivet and a tiestrap are sufficiently close. Alternatively, soldering may be used where the clearances between components are larger than may be accommodated by a brazing technique. Both brazing and soldering, however, require the application of heat, which may impact any selective heat treatment hardening described above with respect to FIGS. 7 to 10 that may have been applied prior to bonding a rivet to a tiestrap.

Selective hardening may need to be applied prior to preset assembly to ensure only targeted portions of a rivet and/or tiestrap are hardened. Hardening may involve heat treatment and/or be impacted by the subsequent application of heat, e.g. by a brazing or soldering process. In such embodiments, either mechanical means of preventing rotation may be employed, or the selection of either a brazing or soldering process can be made with respect to the timing and method of any heat treatment process. Specifically, temperatures used for heat treatment may compare to temperatures necessary for brazing or soldering, and a selection of the order of steps may be made to ensure that subsequently performed processes do not adversely impact earlier processes. For example, if soldering requires a lower temperature than heat treatment and would not impact hardening, soldering may be carried out after heat treatment. Conversely, if brazing is employed, which typically employs higher temperatures than soldering and may further require a higher temperature than heat treatment, it may be carried out prior to heat treatment. However, it may be possible to carry out brazing or soldering, and heat treating at the same time, depending upon the respective temperatures required by the various processes. It will be appreciated that the sequencing of brazing/soldering and heat treating steps may be done with consideration given to the various temperatures required for each step and the impact each step may have on previous or subsequent steps. For example, employing heat treatment post-brazing may affect the ability to selectively harden portions of the preset, as the tiestrap and rivets will effectively form a single piece.

Figure 11:
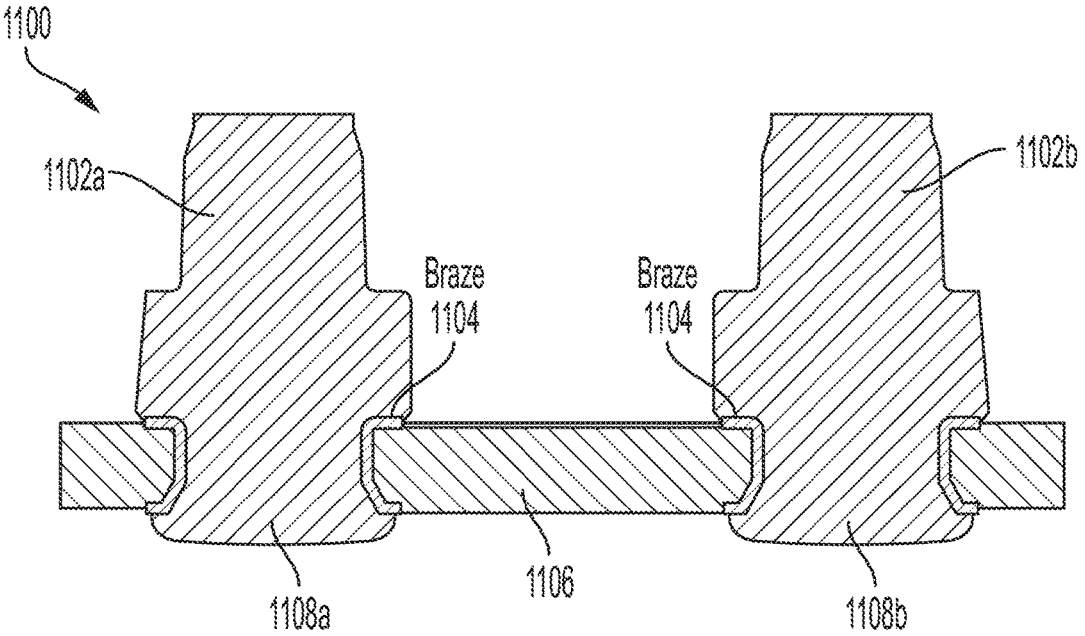
FIG. 11 is a cross-sectional view of a preset illustrating securing of the rivets to the tiestrap via brazing, according to some embodiments.

FIG. 11 demonstrates brazing for securing a rivet to a tiestrap. Each rivet 1102*a,* 1102*b* is secured to tiestrap 1106 via braze 1104, flowed into the rivet holes in tiestrap 1106 to fill the interface between rivets 1102 and tiestrap 1106. The process of heat treating/hardening the preset, as described above with reference to FIGS. 7 to 10, may also be sufficient in some embodiments to cause braze to flow into the rivet-tiestrap interface, thus securing and hardening the preset in a single step, such as when tiestrap 1106 is hardened to a second hardness level, as described above.

Figure 12A:
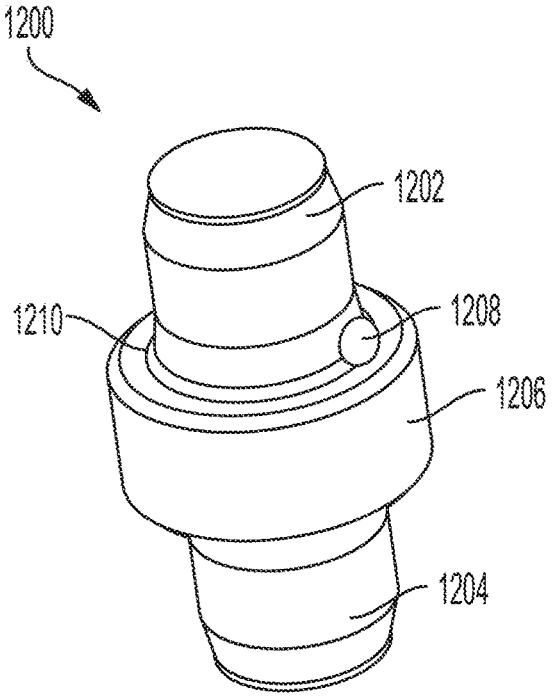
FIGS. 12A and 12B are side perspective views of a rivet for a preset, illustrating possible locations for placement of a brazing compound, according to some embodiments.
Figure 12B:
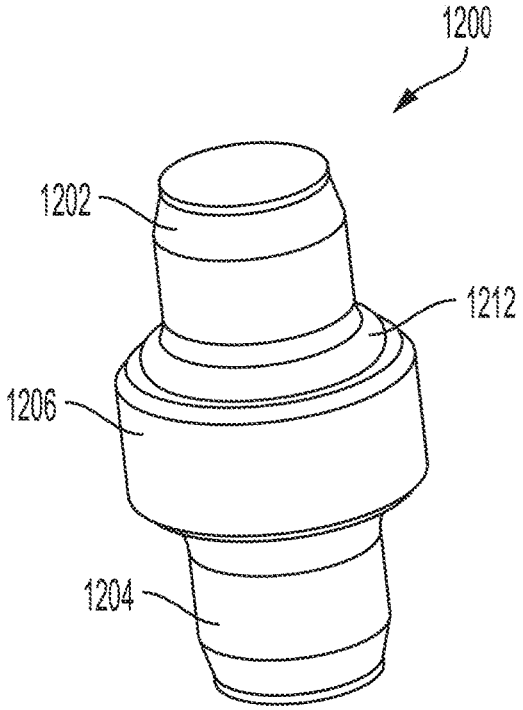

FIGS. 12A and 12B provide a closer depiction of a rivet 1202, to demonstrate how braze may be deployed. Although rivets 1202 are depicted as concentric in the depicted embodiments, it will be appreciated that the disclosed brazing aspects are equally applicable to rivets with non-concentric and/or non-circular flanges. Each rivet 1202 may include a hub 1204 located axially on each side of flange 1206. Where each hub 1204 interfaces a side of flange 1206, it may form a lip, rim, or groove 1210. Into this groove 1210 braze may be placed. In some embodiments, such as FIG. 12A, a simple dot 1208 of braze may be used. In other embodiments, such as FIG. 12B, groove 1210 may be circumferentially filled with a bead 1212 of braze. The choice of amount and location of braze to be used, e.g. a dot 1208, bead 1212, or other application amount and location, may depend upon the size of the components involved, namely the rivet and tiestrap, as well as the type of materials used, and the type and nature of the braze employed.

The employed braze may be any compound now known or later developed suitable for use in brazing, which is also sufficiently durable to withstand the stresses imposed between the rivet and tiestrap while a saw chain is in use. Examples may include rods or pellets of brazing metal, or brazing paste, which may include both filler metal and a flux. As will be further appreciated, tinning, where a layer of braze or solder may be applied to a work surface prior to part assembly, may be employed prior to assembly. Braze or solder may be added during the forming process, such as placing brazing compound in a cavity such as groove 1210 prior to assembly and forming it onto the part. Still further, brazing may be applied via an electroplating process, such as nickel-plating prior to assembly. A person skilled in the art will recognize other possibilities for the timing of applying of brazing or soldering, which are within the scope of this application.

Figure 13:
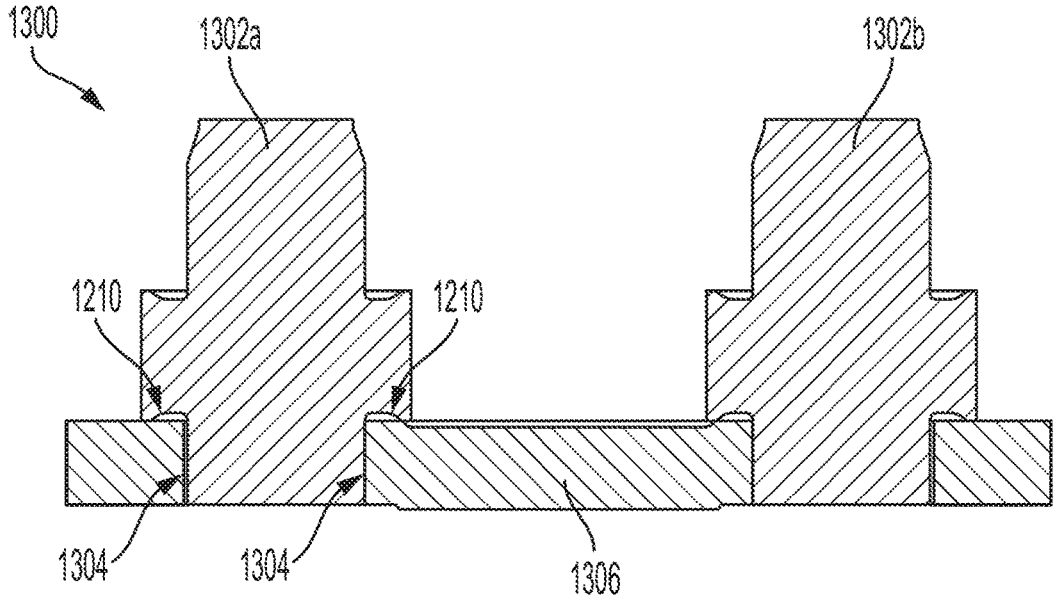
FIG. 13 is a cross-sectional view of a preset illustrating channels for flowing of brazing compound, according to some embodiments.

While FIG. 11 depicts brazed rivets that also have spun heads 1108*a* and 1108*b,* where brazing or soldering is employed forming spun heads may be unnecessary. The brazing or soldering may be sufficiently strong to secure the rivets to the tiestrap, allowing the step of forming rivet heads to be omitted, and further saving on the amount of material needed to produce each rivet, as the material that would have gone to forming a spun head is not needed. FIG. 13 depicts this scenario, in which preset 1300 includes rivets 1302*a,* 1302*b* that are secured to tiestrap 1306 only via brazing 1304, and no spun or formed heads are present, as each rivet 1302 ends substantially flush with tiestrap 1306. Also shown is groove 1210 on rivet 1302 which, as described above, may provide a reservoir to retain braze prior to brazing, allowing it to wet the tiestrap 1306 and hub of rivet 1302 during the brazing (or heat treating) process. In other embodiments, each rivet 1302 may have an initial head formed, such as to retain each rivet post-formation but prior to any heat treating and/or brazing, and then have such heads ground down flush to tiestrap 306 following brazing.

Figure 14A:
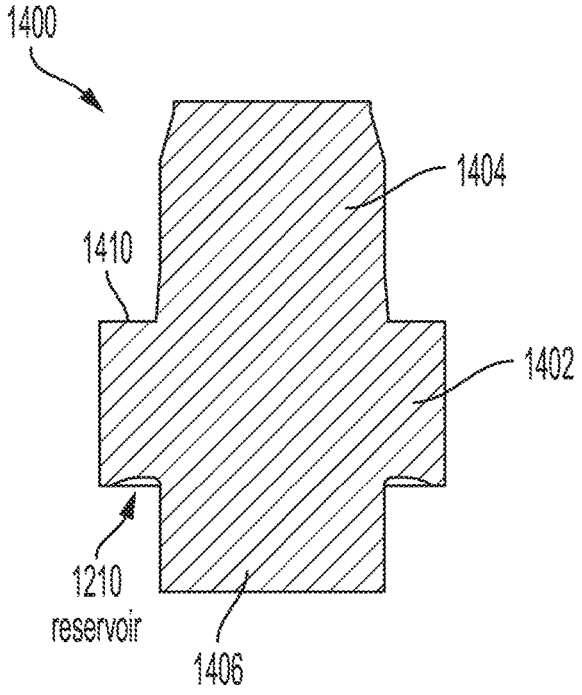
FIGS. 14A and 14B are cross-sectional views of a rivet illustrating a reservoir channel for receiving brazing compound, and the channel with brazing compound, according to some embodiments.
Figure 14B:
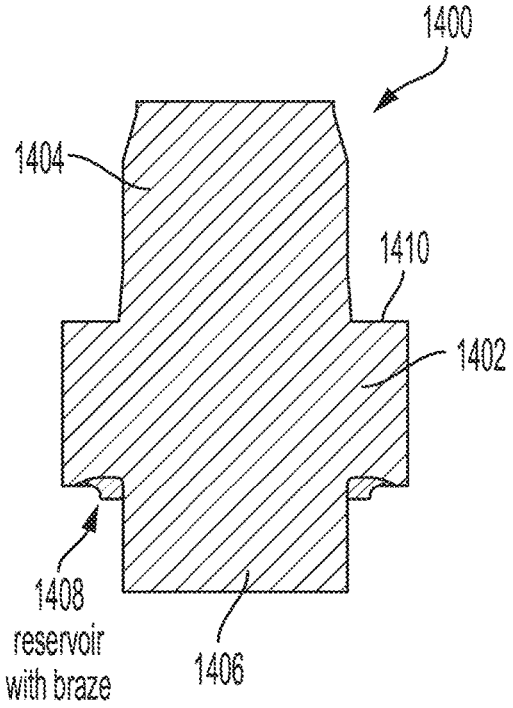

FIGS. 14A and 14B provide a closer depiction of an embodiment of rivets 1302. Rivet 1400 has a flange 1402, a first hub 1404, and a second hub 1406. As can be seen, second hub 1406 is shorter than first hub 1404, as second hub 1406 is intended to be secured to a tiestrap only by means of brazing or soldering, without forming a spun head. Longer first hub 1404 may be configured to be attached to a second tiestrap during saw chain assembly by means of forming a spun head. FIG. 14A again depicts groove 1210 to act as a reservoir, but is located on flange 1402 on the interface with the shorter second hub 1406, as second hub 1406 is to be brazed. Lip 1410, on flange 1402 with the interface with longer first hub 1404, may lack groove 1210, as first hub 1404 may only be secured via a spun head. In other embodiments, lip 1410 may also include a groove 1210 for further brazing after spun head formation. Still other embodiments may present rivet 1400 as symmetrical, with first hub 1404 and second hub 1406 being of identical size and configuration. Such an embodiment of rivet 1400 may be employed where a second tiestrap will be secured only via soldering or brazing upon assembly of a saw chain, and no spun heads will be employed in assembling the preset or associated saw chain.

FIG. 14B depicts groove 1210, acting as a reservoir, here filled with braze 1408. Alternatively, where soldering is employed, groove 1210 may be filled with solder or solder and flux. Groove 1210 may be located in an area where it will not be disturbed during preset assembly, and may be sized and/or shaped to provide and/or facilitate the necessary capillary or wetting action to cause the braze to be drawn into the fissure formed between rivet 1400 and a tiestrap, thereby securing rivet 1400 to the tiestrap.

Figure 15A:
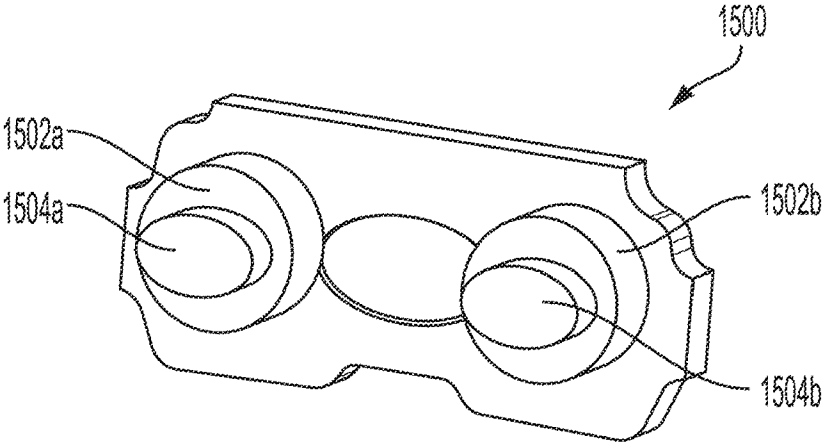
FIG. 15A is a perspective view of a preset with rivets that have hubs with ovoid cross-sections, according to some embodiments.
Figure 15B:
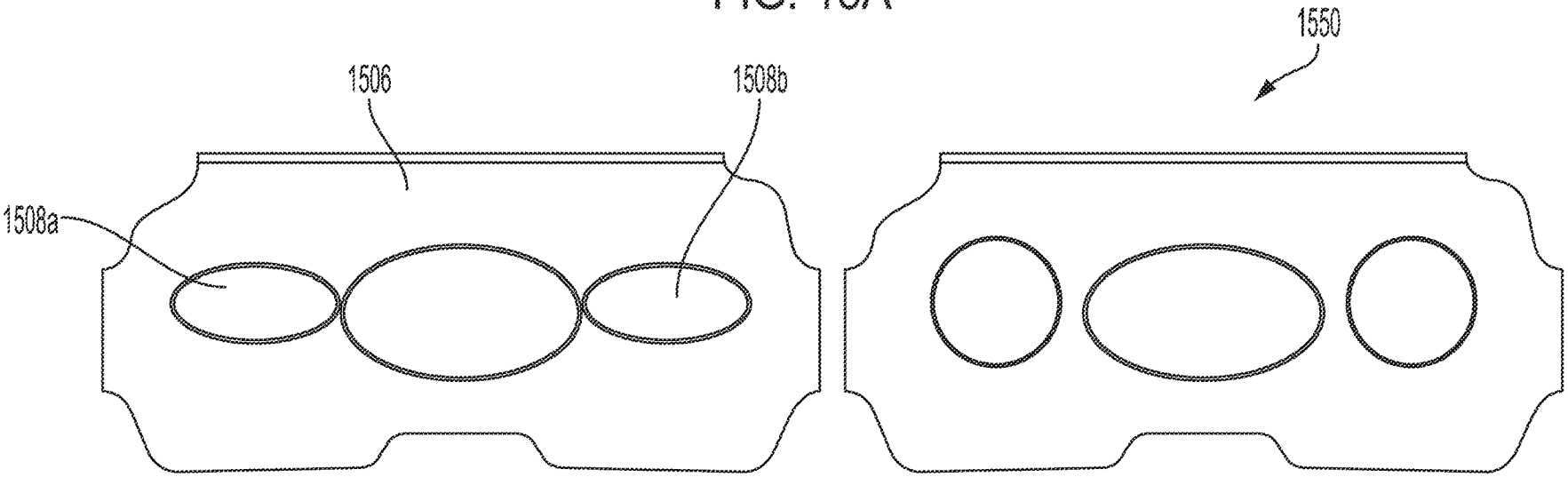
FIG. 15B is a rear view of the preset of FIG. 15A alongside a preset with round rivet hubs for comparison purposes, according to some embodiments.

FIGS. 15A and 15B depict one possible mechanical means of securing rivets to a tiestrap that may be used with a spun head, while still preventing a rivet from rotating with respect to the tiestrap into an undesired position. Preset 1500 includes rivets 1502*a* and 1502*b,* each of which have an ovoid shaped hub 1504*a,* 1504*b,* respectively. Hubs 1504*a* and 1504*b* are sized to mate with ovoid-shaped rivet holes 1508*a* and 1508*b,* respectively, on tiestrap 1506. The ovoid shaped hubs 1504 prevent rotation of each rivet 1502, compared with tiestrap 1550 shown in FIG. 15B, which employs round rivet holes. While an ovoid shape is one possible embodiment of a hub shape that prevents rotation, other shapes may be used, as will be seen further herein. In some embodiments, hub 1504 may have a "keyed" shape, which allows insertion in only one orientation (compared to the ovoid shape depicted, which may allow insertion in two orientations that are 180 degrees opposed). Such an embodiment may be useful where rivet 1502 has only one correct orientation for its intended purpose; the keyed shape will help ensure correct and speedy assembly of preset 1500. Rivets 1502 may be secured to tiestrap 1506 using any of the means described herein, e.g. spun or pressed heads, brazing, soldering, or another suitable method.

Soldering, as discussed above, is an alternative method that may be employed in some embodiments. In particular, rivets and tiestraps may be configured to allow for a relatively low temperature soldering process that will not affect the hardness of either the tiestrap or the rivet. Various embodiments suitable to such processes are depicted in FIGS. 16-19. These embodiments may also be suitable for brazing techniques in whole or in part, and also in combination with other securing methods, including spun heads.

Figure 16:
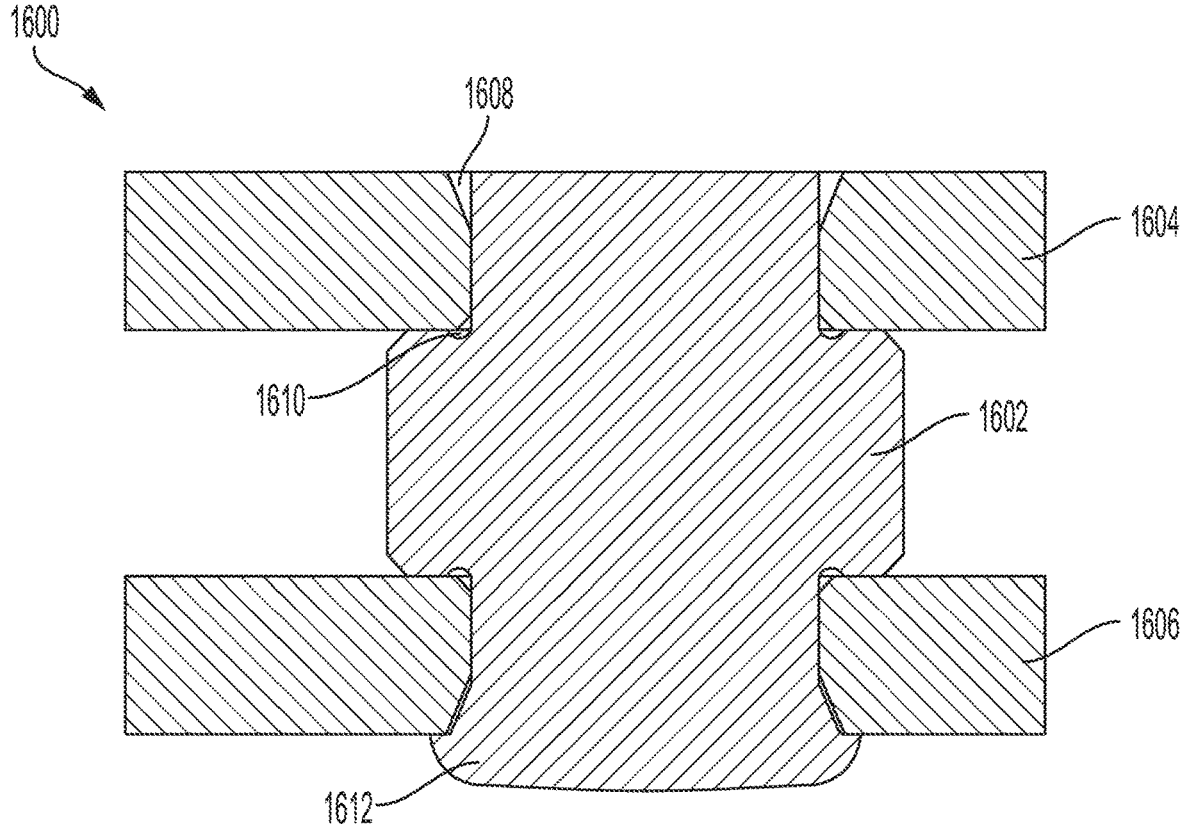
FIG. 16 is a cross-sectional view of a tiestrap and rivet illustrating placement of solder or brazing compound to secure the rivet to the tiestrap, according to some embodiments.

FIG. 16 depicts part of a completed preset 1600 that includes a rivet 1602 with a flange, which is secured between tiestraps 1604 and 1606. Several methods of fastening are shown: rivet 1602 is secured to tiestrap 1604 via a soldering process, which may include placing solder within a countersink 1608. Likewise, solder or braze may be used to secure rivet 1602 to tiestrap 1604 between the flange and the tiestrap 1604 at location 1610, which may include a groove for holding braze or solder, similar to groove 1210. Rivet 1602 is secured to tiestrap 1606 via a spun head 1612, and may also be brazed, as described above.

Figure 17:
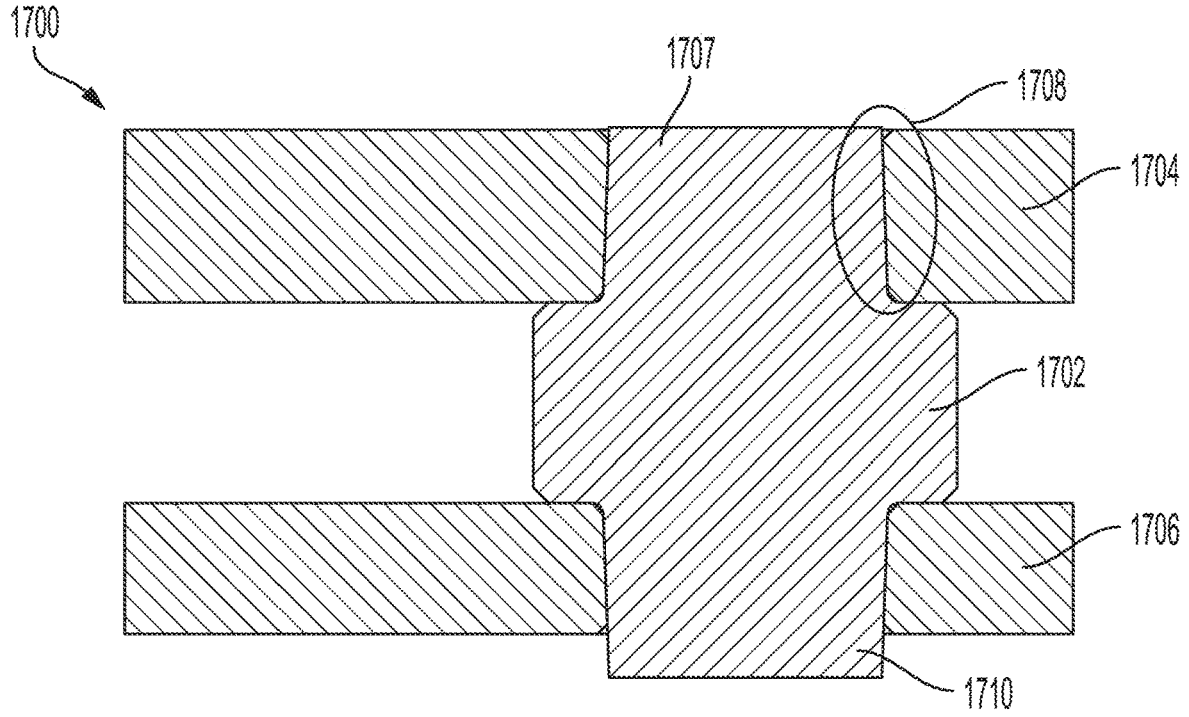
FIG. 17 is a cross-sectional view of a tiestrap and rivet illustrating a rivet with tapered hubs and corresponding tapered holes in the tiestrap, according to some embodiments.

The embodiment in FIG. 17 includes part of a preset 1700, where, like preset 1600, a rivet 1702 is secured to tiestraps 1704 and 1706. Here, each hub of rivet 1702 includes a taper 1708, which mates with a correspondingly tapered rivet hole. By tapering both the hub and rivet hole, a self-centering effect can be achieved, which may assist in assembly of the preset 1700 and associated saw chain. If the taper between the hub and rivet hole varies, for example, the rivet hole tapers more severely than the hub, a press-fit configuration may be achieved. In such an embodiment, rivet 1702 is first centered, then encounters resistance partially through the tiestrap 1704, and finally must be press-fit into position, which may aid in securing rivet 1702. A partial gap may nevertheless result between tiestrap 1704 and rivet 1702, which can be filled by brazing or soldering in some embodiments, as discussed herein.

Preset 1700 here demonstrates two alternative embodiments, including a hub end 1707 that is secured only by brazing or soldering, and a hub end 1710 that may be subsequently spun or pressed to form a rivet head. Also, it will be observed that the length of hub end 1707 is identical to unformed hub end 1710. Rather, tiestrap 1704 has a greater thickness than tiestrap 1706. By securing rivet 1702 using a brazing process rather than forming a head, the tiestrap may be made thicker while still maintaining the overall width of a completed saw chain. The width that would otherwise be consumed by a spun rivet head instead can be devoted to thicker tiestraps, improving the durability of the saw chain and increasing the amount of force the saw chain may withstand without failure.

Figure 18:
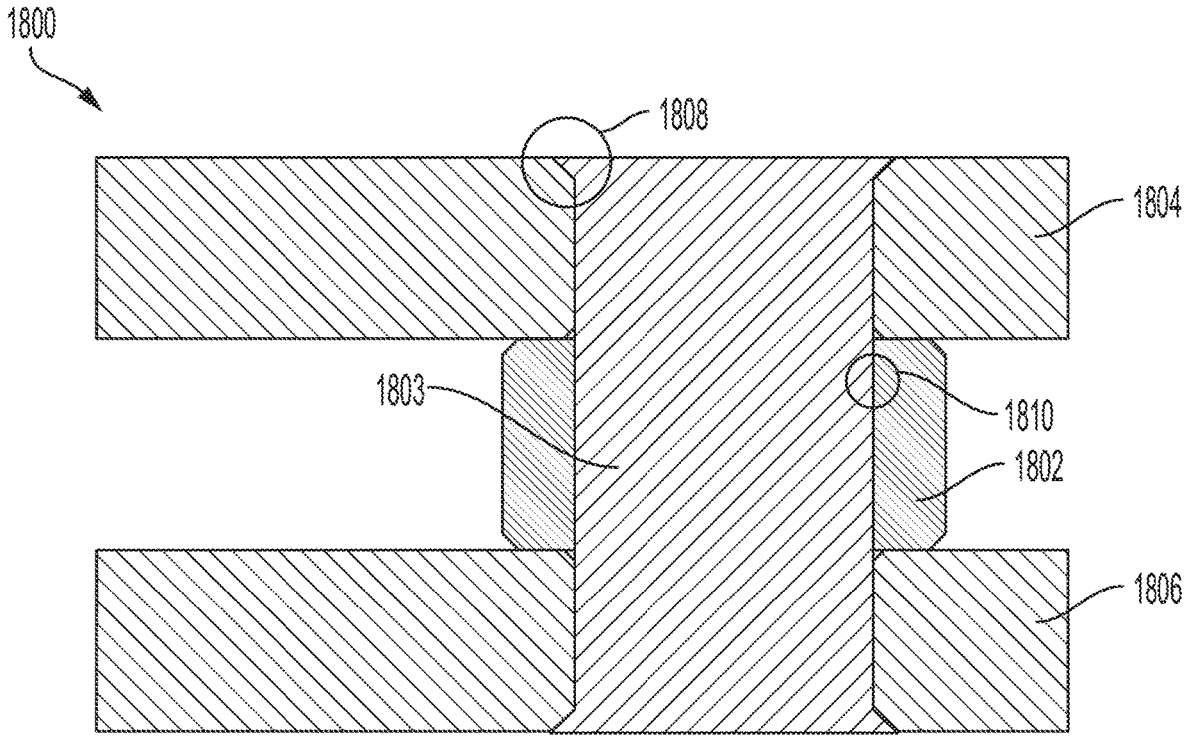
FIG. 18 is a cross-sectional view of a tiestrap and rivet illustrating a two-piece rivet, with the flange shown as a separate component from the rivet hub, according to some embodiments.

FIG. 18 depicts a portion of a preset 1800 where the rivet is split into two parts: a rivet flange 1802, and a rivet hub 1803. As can be seen, in the depicted embodiment, rivet flange 1802 is essentially a hollow tube, through which is passed rivet hub 1803, essentially a shaft. Securing hub 1803 to tiestraps 1804 and 1806 secures flange 1802 during assembly of the saw chain. Hub 1803 is secured to each tiestrap 1804 and 1806 by forming an essentially flush head 1808, such as by countersinking the rivet hole in tiestrap 1804 and 1806, and pressing the ends of hub 1803 to fill the countersink. It will be understood that creating a flush head may also be used with one-piece rivets, as disclosed in connection with earlier figures.

Alternatively, brazing or soldering as described above with respect to FIG. 16 may be employed, or a combination of the foregoing. Flange 1802 may be brazed or soldered 1810 to hub 1803 in some embodiments to prevent rotation; in other embodiments, flange 1802 may be allowed to rotate about hub 1803 to form a roller chain. In roller chain embodiments, flange 1802 and/or hub 1803 and/or tiestraps 1804 and/or 1806 may have channels or features to allow lubrication, such as bar oil, to work between flange 1802 and hub 1803 to reduce friction and wear, and facilitate the rotation of flange 1802.

The separation of the rivet into flange 1802 and hub 1803 may facilitate the use of different types and/or hardnesses of materials. For example, flange 1802 may be comprised of an alloy at least 60 HRC, while hub 1803 may be of a softer material or different metal that is more easily formed, where it is secured via countersunk or conventional spun heads. Still further, hub 1803 may be a non-round shape, with at least the inner tunnel through flange 1802 correspondingly shaped to receive hub 1803. Such an embodiment will allow for correctly orienting a non-concentric flange 1802 upon hub 1803, as described above with reference to the other figures.

Figure 19:
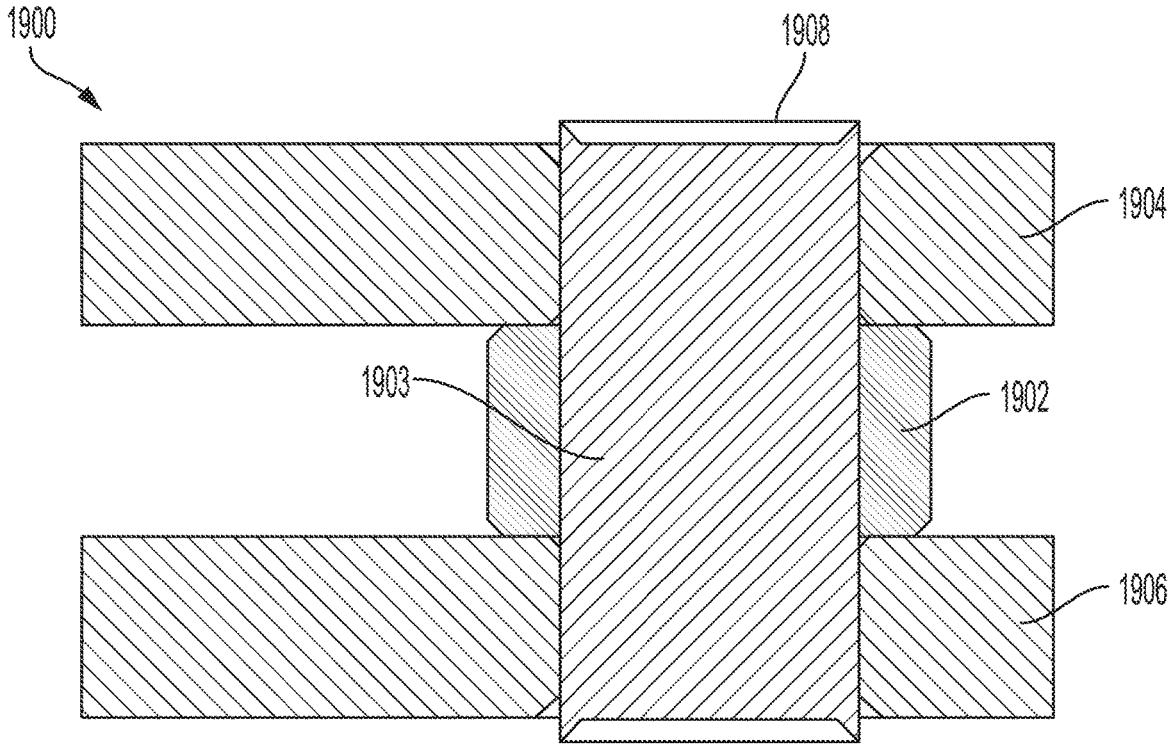
FIG. 19 is a cross-sectional view of a tiestrap and rivet illustrating a two-piece rivet, with the flange shown as a separate component from the rivet hub, and the hub including protruding material for attachment via welding, according to other embodiments.

FIG. 19 depicts an embodiment similar to preset 1800, with part of preset 1900 including a two-part rivet of flange 1902 and hub 1903, which is secured between tiestraps 1904 and 1906. However, hub 1903 may be secured using a welding process, where the material to be joined 1908 is heated until melting, and then fused to the surrounding tiestrap 1904 or 1906. The tiestrap may then be selectively hardened. While a welding process may require more heat, it may be appropriate for some applications depending upon the materials used and the intended application for a saw chain incorporating preset 1900. As with preset 1800, flange 1902 may be brazed or soldered to hub 1903, and flange 1902 and hub 1903 may be shaped or keyed to ensure a proper orientation of flange 1902. Likewise, a welding process may be used with a one-piece rivet. Flange 1902 alternatively may be allowed to spin free upon hub 1903 when hub 1903 is a round shaft, allowing flange 1902 to comprise a roller bearing, as described with respect to FIG. 18 above.

Where a preset includes a flange that can rotate, either around a round hub or via a round hub through a round tiestrap rivet hole, a saw chain may be configured to straddle a bar. Portions of each tiestrap may straddle on either side of a bar, and each flange can act as a roller bearing to absorb forces experienced while the chain saw is in use.

Figure 20B:
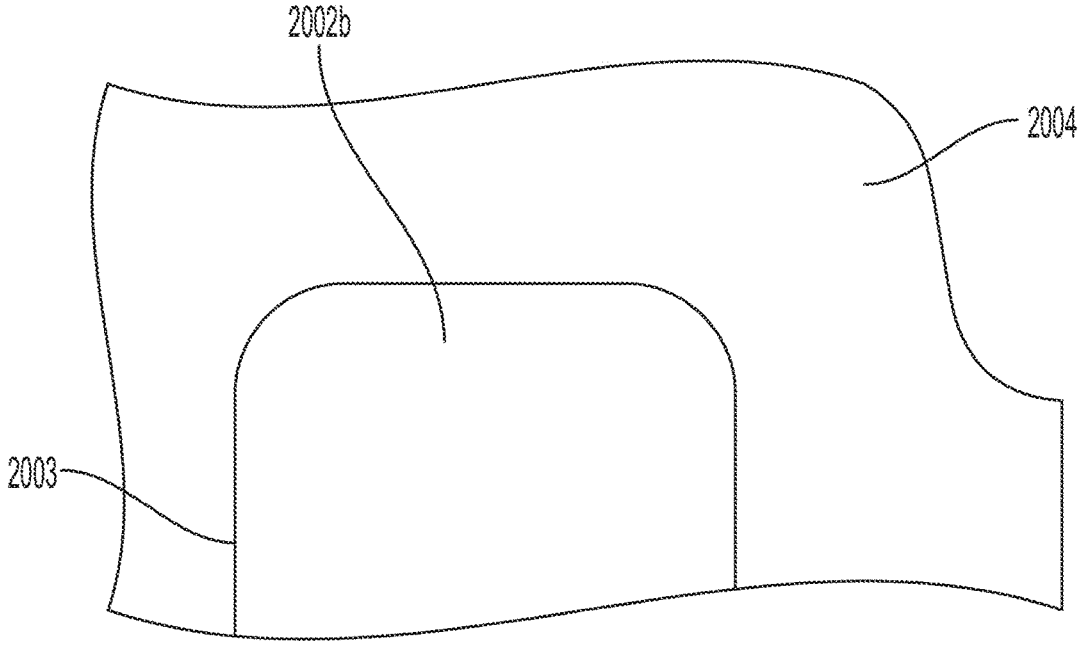

FIGS. 20A and 20B depict an embodiment of a completed preset 2000, but shown apart from surrounding connected links in a saw chain. Preset 2000 includes rivets 2002*a* and 2002*b* that are secured between tiestraps 2004 and 2006. The tiestraps 2004 and 2006 capture flanges 2008*a* and 2008*b* of each rivet 2002. As seen in FIG. 20A, each flange 2008 is substantially round, while each hub is a rounded square, seen on the visible surface of tiestrap 2004. Thus, each rivet 2002 is prevented from rotating with respect to tiestraps 2004 and 2006. Each rivet 2002 may be a single piece, then, with each hub presenting the rounded square cross section, but flange 2008 presenting a round cross section. It will be appreciated that flange 2008 may have other, non-round cross-sections as described above.

Where rivet 2002 is embodied as two pieces, the hub may have a continuously square cross section, with flange 2008 having a matching shaped tunnel, to prevent rotation. Alternatively, flange 2008 could have a round cross section tunnel, with the hub transitioning between a square and round cross section for the ends and center, respectively. Thus, flange 2008 could rest upon a round cross-section portion of the hub, allowing it to rotate if desired, with the hub remaining secure via its square cross section for the portions where it is secured into tiestraps 2004 and 2006.

Still further, other combinations of the various embodiments described above for securing rivets to tiestraps may be employed.

FIG. 20B depicts a close-up of the hub of rivet 2002*b* where it passes through tiestrap 2004. A gap 2003 may be present with tolerances selected depending upon the particular manufacturing process to be employed. For example, and as described above, gap 2003 may be kept to a minimum where a brazing technique is used, or may be of a slightly larger width where soldering is employed. No gap may be present where a spun or pressed head is employed, with the end of each rivet 2002 possibly fitting into a chamfer or countersink in the tiestrap 2004; the head may, in some embodiments, be ground or formed flush to the outer surface of tiestrap 2004. Further, to aid in centering, and especially where the gap 2003 is of a larger width, ribs may be deployed from either tiestrap 2004 or rivet 2002*b*, which may act to center rivet 2002*b*. Alternatives may include tapering, as described above, or any other suitable method of accurately aligning rivet 2002. Finally, while rivet 2002*b* is depicted having a square cross section, as described above with reference to other figures, rivet 2002*b* may have a variety of different cross sections, e.g. round, polygonal, keyed, etc.

Figure 21:
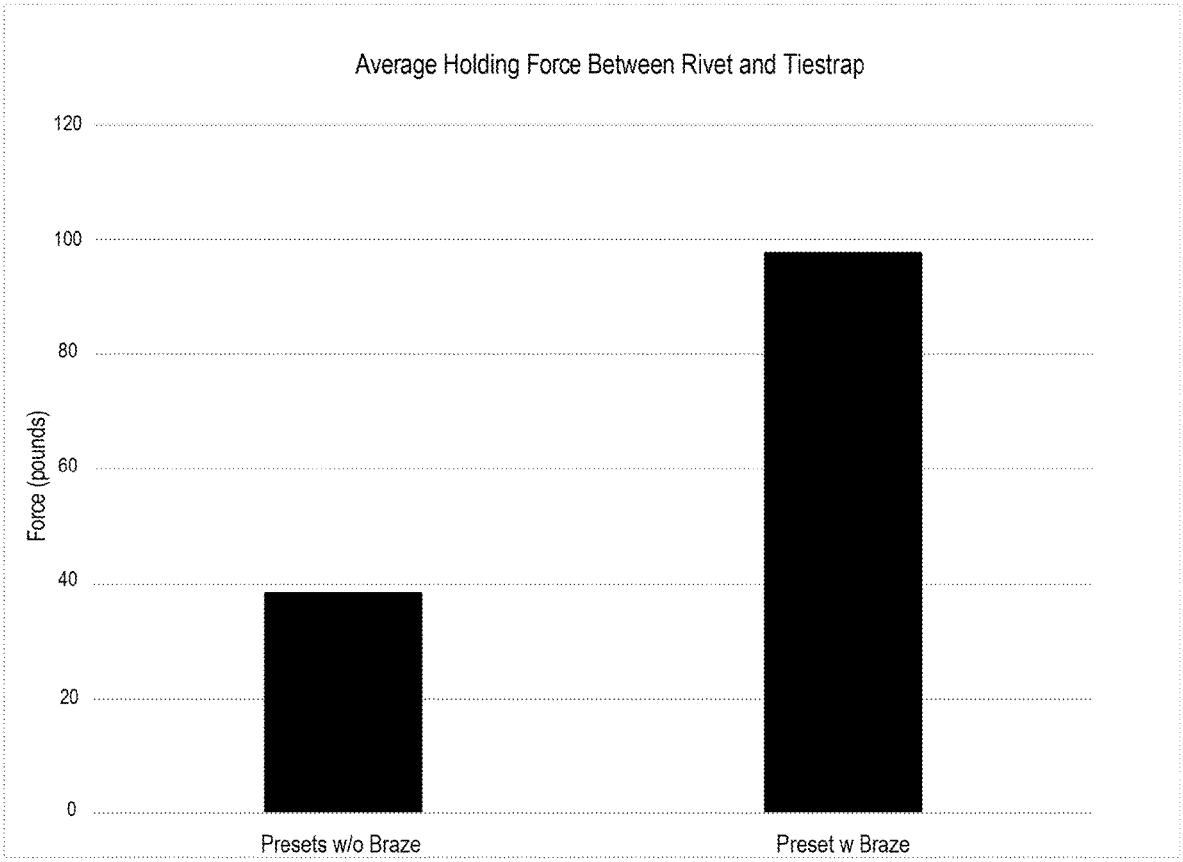
FIG. 21 is a graph comparing the average holding force of a preset constructed without brazing with a preset constructed with brazing, according to some embodiments.

Referring to FIG. 21, the relative advantages of securing a rivet to a tiestrap with and without brazing are depicted. Specifically, the average holding force against a torque or other stress that may be experienced on the saw chain during use is depicted for both brazed and non-brazed rivets. As can be seen, rivets that are not brazed offer an average holding force of just under 40 pounds. In comparison, rivets that are secured to a tiestrap with a brazing process (which may or may not be performed in conjunction with another securing process, such as spinning or forming a rivet head) have an average holding force of nearly 100 pounds. These measurements may fluctuate depending upon the brazing material used and the size of the various components; thus, FIG. 21 should be taken as more of an example of the potential advantages that brazing may offer for manufacturing a preset versus manufacturing a preset without brazing. Likewise, other techniques such as welding or soldering may offer advantages similar to brazing over non-welded or soldered presets, but to a greater or lesser degree than brazing. The choice of brazing, welding, soldering, or simply forming (such as cold-forming) may be made with respect to a particular intended use or uses for a saw chain.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Moreover, the embodiments described in the various figures may be mixed and matched as appropriate for an intended purpose without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A preset for a saw chain, comprising:

a rivet comprised of a hub and a flange with a first side and a second side opposite the first side, the hub extending axially from the first side of the flange and the second side of the flange and having a smaller diameter than the flange; and a tiestrap, into which the hub of the rivet is inserted and secured, wherein the hub is disposed non-concentrically from the flange relative to a longitudinal axis of the tiestrap, and includes a lip that extends radially from a circumference of the flange, the lip configured as an index to properly orient the flange on the tiestrap, wherein the flange includes a groove on the first side and on the second side, each configured to receive braze and positioned proximate to the hub such that the braze can join the rivet to the tiestrap, and wherein the rivet has been at least partially selectively hardened.

2. The preset of claim 1, wherein the rivet is a first rivet, and further comprising a second rivet with a hub and a flange, the hub of the second rivet is inserted and secured to the tiestrap.

3. The preset of claim 2, wherein the hub of the second rivet is disposed non-concentrically from the flange of the second rivet relative to a longitudinal axis of the tiestrap.

4. The preset of claim 1, wherein the hub has a non-round cross-section, and securing the hub into the tiestrap prevents the rivet from rotating with respect to the tiestrap.

5. The preset of claim 1, wherein the rivet has a rivet head extending from an end of the hub that protrudes through the tiestrap, and the hub is secured to the tiestrap by the rivet head.

6. The preset of claim 1, wherein the flange has a non-round cross section.

7. The preset of claim 1, wherein a first portion of the flange is hardened to a first hardness greater than a remaining second portion of the flange.

8. The preset of claim 7, wherein a first portion of the tiestrap is hardened to the first hardness greater than a remaining second portion of the tiestrap.

9. The preset of claim 8, wherein the remaining second portion of the flange and the remaining second portion of the tiestrap are hardened to a second hardness, the second hardness being less than the first hardness.

10. The preset of claim 9, wherein the hub is of a third hardness that is less than the first hardness and second hardness.

11. The preset of claim 1, wherein the hub is a separate component from the flange.

12. The preset of claim 11, wherein the flange is affixed to the hub and prevented from rotating.

13. The preset of claim 1, wherein the preset is disposed non-concentrically such that when tensioned in a saw chain having a longitudinal axis, the preset is pulled to an angle relative to the saw chain longitudinal axis.

14. A method for forming a preset, comprising:

inserting a first rivet with a first hub and a first flange into a corresponding first hole in a tiestrap;

inserting a second rivet with a second hub and a second flange into a corresponding second hole in the tiestrap; and securing the first and second rivets to the tiestrap, wherein the first hub is disposed non-concentrically from the first flange relative to a longitudinal axis of the tiestrap, wherein at least one of the first flange and the second flange include a groove configured to receive braze, the groove of the first flange and the second flange each oriented so that the braze secures the first and second rivets to the tiestrap, wherein at least one of the first flange and the second flange further includes a lip that extends radially from a circumference of the first or second flange, the lip configured as an index to properly orient the first or second flange on the tiestrap; and wherein the first and second rivets are secured to the tiestrap by brazing.

15. The method of claim 14, further comprising selectively heat-treating at least a portion of one of the first or second rivets to a predetermined hardness.

16. The method of claim 15, further comprising selectively heat-treating at least a portion of the tiestrap to a predetermined hardness.

17. The method of claim 15, wherein the portion is a first portion, the predetermined hardness is a first predetermined hardness, and further comprising selectively heat-treating at least a second portion of the tiestrap to a second predetermined hardness that is different from the first predetermined hardness.

18. The method of claim 17, wherein:

the first predetermined hardness has a hardness ranging from around 58-62 HRC (rockwell hardness);

the second hardness has a hardness ranging from around 40-55 HRC; and an unhardened material has a hardness ranging from around 20-45 HRC.

19. The method of claim 14, wherein the second flange is disposed non-concentrically from the second hub.

* * * * *